US011920610B2

(12) United States Patent
Huang et al.

(10) Patent No.: US 11,920,610 B2
(45) Date of Patent: Mar. 5, 2024

(54) AIR PUMP ASSEMBLY HAVING A ROTATABLE ASSEMBLY FOR FLOWING AIR INTO OR OUT OF AN INFLATABLE PRODUCT

(71) Applicant: Intex Marketing Ltd., Road Town (VG)

(72) Inventors: Zhi Xiong Huang, Fujian (CN); Ying Biao Zhang, Fujian (CN); Zheng Wen Lin, Fujian (CN)

(73) Assignee: Intex Marketing Ltd., Tortola (VG)

( * ) Notice: Subject to any disclaimer, the term of this patent is extended or adjusted under 35 U.S.C. 154(b) by 0 days.

(21) Appl. No.: 18/027,150

(22) PCT Filed: Jan. 14, 2022

(86) PCT No.: PCT/IB2022/050303
§ 371 (c)(1),
(2) Date: Mar. 20, 2023

(87) PCT Pub. No.: WO2022/153239
PCT Pub. Date: Jul. 21, 2022

(65) Prior Publication Data

US 2023/0258199 A1 Aug. 17, 2023

(30) Foreign Application Priority Data

Jan. 14, 2021 (CN) ..... 202120101406.4

(51) Int. Cl.
*F04D 29/42* (2006.01)
*F04D 25/06* (2006.01)
(Continued)

(52) U.S. Cl.
CPC ..... *F04D 29/4206* (2013.01); *F04D 25/06* (2013.01); *F04D 17/16* (2013.01); *F04D 25/0673* (2013.01); *F04D 29/624* (2013.01)

(58) Field of Classification Search
None
See application file for complete search history.

(56) References Cited

U.S. PATENT DOCUMENTS 6,733,254 B1 * 5/2004 Yen ..... F04D 17/16 415/206
6,955,529 B2 10/2005 Tsai
(Continued)

FOREIGN PATENT DOCUMENTS

CN 210423098 * 4/2020 ..... F04D 25/08

OTHER PUBLICATIONS

18027150_machinetranslation_CN210423098.pdf; Paten Translate, Espacenet, 8 Pages, downloaded Jul. 12, 2023. (Year: 2020).*
(Continued)

*Primary Examiner* — Nathan C Zollinger
*Assistant Examiner* — Timothy P Solak
(74) *Attorney, Agent, or Firm* — Faegre Drinker Biddle & Reath LLP

(57) ABSTRACT

An air pump assembly for an inflatable product may include a housing, a cover coupled to the housing, and a rotatable assembly supported by the housing. The rotatable assembly may include a pump housing having first and second air vents, an impeller positioned within the pump housing, a motor operatively coupled to the impeller, and a rotary disc positioned between the pump housing and a vent hole of the housing. The rotatable assembly may be rotatable to a first position wherein air flows from the first air vent of the pump housing to the second air vent of the pump housing and through the vent hole in the housing into an interior of the inflatable product and a second position wherein air flows from the interior of the inflatable product through the vent hole in the housing into the first air vent and then to the second air vent.

17 Claims, 22 Drawing Sheets

(51) Int. Cl.
*F04D 17/16* (2006.01)
*F04D 29/62* (2006.01)

(56) References Cited

U.S. PATENT DOCUMENTS

| | | | | |
|---|---|---|---|---|
| 10,273,966 | B2 * | 4/2019 | Lau | F04D 25/06 |
| 10,837,452 | B2 * | 11/2020 | Huang | F04D 25/166 |
| 11,680,573 | B2 | 6/2023 | Huang et al. | |
| 2006/0198741 | A1 * | 9/2006 | Wu | F04D 25/084<br>417/406 |
| 2006/0204361 | A1 * | 9/2006 | Xie | F04D 25/082<br>415/182.1 |
| 2010/0247356 | A1 * | 9/2010 | Tsai | F04D 29/602<br>417/423.14 |
| 2012/0107157 | A1 * | 5/2012 | Tsai | F04D 25/084<br>417/423.14 |

OTHER PUBLICATIONS

International Search Report and Written Opinion as issued by the International Searching Authority, dated Jul. 28, 2022, for International Patent Application No. PCT/IB2022/050303; 16 pages.
International Report on Patentability as issued by the International Searching Authority, dated Dec. 8, 2022, for International Patent Application No. PCT/IB2022/050303; 19 pages.
International Preliminary Report on Patentability issued by the International Searching Authority, for International Patent Application No. PCT/IB2022/050303, dated Aug. 12, 2022; 6 pages.
International Search Report and Written Opinion issued by the International Searching Authority, for International Patent Application No. PCT/IB2022/050303, dated Jul. 28, 2022; 17 pages.

* cited by examiner

AIR PUMP ASSEMBLY HAVING A ROTATABLE ASSEMBLY FOR FLOWING AIR INTO OR OUT OF AN INFLATABLE PRODUCT

RELATED APPLICATION

The present application is a national stage entry of International (PCT) Patent Application Number PCT/IB2022/050303, filed Jan. 14, 2022, which claims priority to Chinese Application CN202120101406.4, filed Jan. 14, 2021, the entire disclosures of which are expressly incorporated by reference herein.

TECHNICAL FIELD

The present disclosure relates to an inflatable product, in particular to an air pump assembly.

BACKGROUND

At present, there are many inflatable products on the market. Inflatable products can achieve their due function due to volume expansion when they are full of air, and they can be easily folded and stored or carried out when they are fully deflated. The inflating and deflating device matched with inflatable products comprises pumps, electric pumps, and built-in air pumps. The separate pumps and electric pumps are used to inflate and deflate manually, which are time-consuming and labor-intensive, inconvenient to carry, and troublesome to operate, and they are replaced by a built-in air pump.

The built-in air pump uses a motor to drive a blade to rotate, thereby sucking the outside air into the inflatable product. A closed end of the blade is on the other side of the air inlet, the air at the inlet and outlet are easily channeling, which affects the wind pressure and flow efficiency. In order to improve the low efficiency of the lower closed blade, an upper cover plate is provided in the traditional product, the upper cover plate is fixed to the closed blade through ultrasonic waves, glue dispensing, etc. The closed blade increases the sealing of the blade and improves the efficiency. Exemplary shortcomings include the production process is complicated, the synthesized blades are poorly balanced, and the cost is high.

SUMMARY

In an exemplary embodiment of the present disclosure, an air pump assembly for an inflatable product is provided. Air at the inlet and outlet of an air pump of the air pump assembly is not easily channeled, has improved efficiency, and a simplified production process.

In another exemplary embodiment of the present disclosure, an air pump assembly for an inflatable product having an interior is provided. The air pump assembly may comprise a housing having a vent hole in fluid communication with the interior of the inflatable product, a cover coupled to the housing, and a rotatable assembly supported by the housing. The cover may include a plurality of vent openings. The rotatable assembly may comprise a pump housing having a first air vent and a second air vent, an impeller positioned in the pump housing, and a motor operatively coupled to the impeller to drive a rotation of the impeller. The rotatable assembly being rotatable to a first position wherein air flows from the first air vent of the pump housing to the second air vent of the pump housing and through the vent hole in the housing into the interior of the inflatable product and a second position wherein air flows from the interior of the inflatable product through the vent hole in the housing into the first air vent of the pump housing to the second air vent of the pump housing.

In an example thereof, the motor may maintain an orientation relative to each of the first air vent of the pump housing and the second air vent of the pump housing when the rotatable assembly is in both the first position and the second position.

In another example thereof, the rotatable assembly may further include a rotating handwheel which extends through an opening in the cover. In a variation thereof, the motor may be captured between the rotating handwheel and the pump housing. In a further variation thereof, the rotating handwheel may maintain an orientation relative to each of the first air vent of the pump housing and the second air vent of the pump housing when the rotatable assembly is in both the first position and the second position.

In a further example thereof, the rotatable assembly may further include a rotary disc, the rotary disc being positioned between the pump housing and the vent hole of the housing. In a variation thereof, the rotary disc may include a first air vent and a second air vent. The first air vent of the rotary disc may communicate air to the first air vent of the pump housing when the rotatable assembly is in the first position and the first air vent of the rotary disc may receive air from the first air vent of the pump housing when the rotatable assembly is in the second position. In a further variation thereof, the rotating handwheel may maintain an orientation relative to the rotary disc when the rotatable assembly is in both the first position and the second position. In yet a further variation thereof, a sealing ring may be positioned between the rotary disc and the housing and about the vent hole in the housing. In still a further variation thereof, a pressure plate may couple the rotary disc to the housing.

In yet a further example thereof, the impeller may include a circular ring cover plate having a central opening and at least one blade coupled to the circular ring cover plate. In a variation thereof, the impeller may further comprise a baffle extending from the circular ring cover plate in a first direction, the at least one blade extending from the circular ring cover plate in a second direction, the second direction being opposite the first direction. In a further variation thereof, the baffle may be received in a recess in the pump housing. In yet a further variation thereof, the impeller may further comprise at least one attachment blade extending from the baffle.

In still a further example thereof, the rotatable assembly may further includes a circuit board operatively coupled to the motor and a switch operatively coupled to the circuit board to control operation of the motor. In a variation thereof, the cover may include a control plate which cooperates with the switch to control operation of the motor.

In still another exemplary embodiment of the present disclosure, an air pump assembly for an inflatable product is provided. The air pump assembly may comprise a housing and an air pump positioned in the housing. The air pump may comprise a rotating assembly including a motor and an impeller. The impeller may include a blade and a circular ring cover plate may be arranged along a circumferential direction on a side of the blade away from the motor. An inner ring of the circular ring cover plate may be an air inlet of the air pump. The housing may be provided with a socket for connecting with an external power source. The socket may be a USB interface or a Type-C interface.

In an example thereof, the inner ring of the circular ring cover plate may extend a circle of baffle along the circumferential direction and the baffle may extend away from the motor along the axial direction of the blade. In a variation thereof, a side of the baffle away from an axial direction of the blade may be provided with a plurality of leak-proof attachment blades. The leak-proof attachment blades may be arranged with interval along the circumferential direction of the baffle.

In another example thereof, the external power source may be one of a USB adapter, a USB cigarette lighter or a USB rechargeable battery.

In a further example thereof, the rotating assembly may further comprise a rotating handwheel, an upper pump housing and an airway switch device. The rotating handwheel, the motor, the upper pump housing, and the airway switch device may be sequentially connected from a top of the housing to a bottom of the housing. The bottom of the housing may be provided with a first vent hole. The first vent hole may be connected to a vent hole, of the airway switch device. In a variation thereof, the airway switch device may be provided with an air inlet and an air outlet, and the airway switch device may be arranged that when the rotating assembly rotates, the air inlet and the air outlet can respectively be connected to the first vent hole. In a further variation thereof, the air pump assembly may further comprise a switch. The switch may be fixed to the rotating assembly. The housing may be provided with a control plate that cooperates with the switch. A rotation of the rotating assembly may drive the switch to rotate; the switch contacts with the control plate or separates from the control plate. In yet a further variation thereof, the switch may be further provided with a pin electrically connected to a circuit board, and the circuit board is connected to the socket.

In still yet another example thereof, the bottom of the housing may be provided with a shaft that is connected with the airway switch device. In a variation thereof, the airway switch device may comprise a rotary disc and a lower pump housing. The rotary disc may be connected to the shaft of the housing through a pressure plate. A sealing ring may be arranged on an outer circumference of the first vent hole and arranged in a groove in the housing.

Advantages, among others of one or more embodiments of the present disclosure, include one or more of the following. An air pump assembly for an inflatable product having a cover plate is moved to the air inlet of the blade, which increases the sealing of the air inlet of the blade, and the air at the inlet and outlet is not easily channeling, which improves the efficiency and the production process is simple. An air pump assembly for an inflatable product having a housing is provided with a USB interface or a Type-C interface for connecting an external power source. In this way, external power sources such as power bank, car cigarette lighter conversion USB connector, etc. can be used to supply power to the air pump assembly. This makes it easier for users to find an external power supply that can be used in various environments, so that the inflatable product can be used in various situations. An air pump assembly for an inflatable product takes into account the detachable structure of the air pump, the storage of the air pump power cord and the setting of the spare inflation interface, so that when the inflatable system is set in the inflator, the rotation of the air pump can be used to achieve multiple working modes such as inflating, stopping, and deflating. An accommodating cavity may be provided on the side of the fixed portion of the housing and may be used as a carrier for the air pump power cord on the one hand and may be further provided with an inflatable interface connected to the inner side of the inflatable product. This inflatable interface can use a manual inflator to inflate the inflatable product when the air pump is not working (such as when there is no external power supply). This makes the application scenarios of the inflatable product more diversified.

Additional features and advantages of the present disclosure will become apparent to those skilled in the art upon consideration of the following detailed description of the illustrative embodiment exemplifying the best mode of carrying out the disclosure as presently perceived.

BRIEF DESCRIPTION OF THE DRAWINGS

The foregoing aspects and many of the intended advantages of this disclosure will become more readily appreciated as the same becomes better understood by reference to the following detailed description when taken in conjunction with the accompanying drawings.

Figure 1:
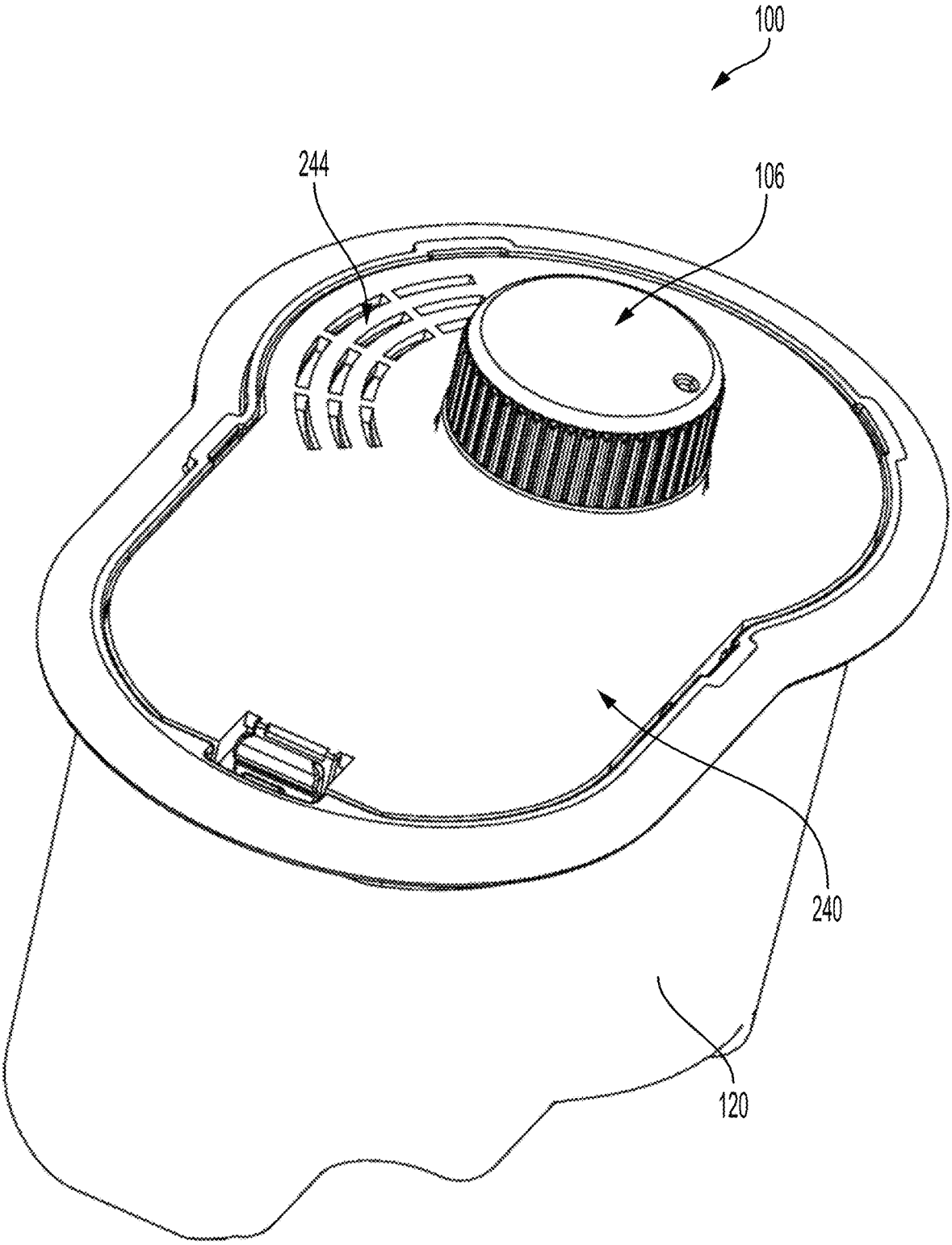
FIG. 1 illustrates a perspective view of an exemplary embodiment of an air pump assembly.

Corresponding reference characters indicate corresponding parts throughout the several views. Although the drawings represent embodiments of various features and components according to the present disclosure, the drawings are not necessarily to scale and certain features may be exaggerated in order to better illustrate and explain the present disclosure. The exemplifications set out herein illustrate embodiments of the disclosure, and such exemplifications are not to be construed as limiting the scope of the disclosure in any manner.

DETAILED DESCRIPTION OF THE EMBODIMENTS

For the purposes of promoting an understanding of the principals of the disclosure, reference will now be made to the embodiments illustrated in the drawings, which are described below. The embodiments disclosed below are not intended to be exhaustive or limit the disclosure to the precise form disclosed in the following detailed description. Rather, the embodiments are chosen and described so that others skilled in the art may utilize their teachings. It will be understood that no limitation of the scope of the disclosure is thereby intended. The disclosure includes any alterations and further modifications in the illustrative devices and described methods and further applications of the principles of the disclosure which would normally occur to one skilled in the art to which the disclosure relates.

In the description, it should be noted that the terms upper, lower, inner, outer, top/bottom, etc. indicating the orientation or positional relationship based on the orientation shown in the drawings are only for the convenience of simplifying the description, rather than indicating or implying that the pointed device or element must have a specific orientation, be constructed and operated in a specific orientation, and therefore cannot be understood as a limitation of the present disclosure. In addition, the terms first and second are only used for descriptive purposes, and cannot be understood as indicating or implying relative importance.

In the description, it should be noted that the terms installed, provided with, socketed/connected, connected, etc., should be understood broadly, connection can be wall-mounted connection, detachable connection, or integral connection, mechanical connection or electrical connection, direct connection, or indirect connection through an intermediate medium, and it can be inside two components. For those of ordinary skill in the art, the specific meaning of the above terms in the present disclosure can be understood under specific conditions.

Embodiment 1

Figure 2:
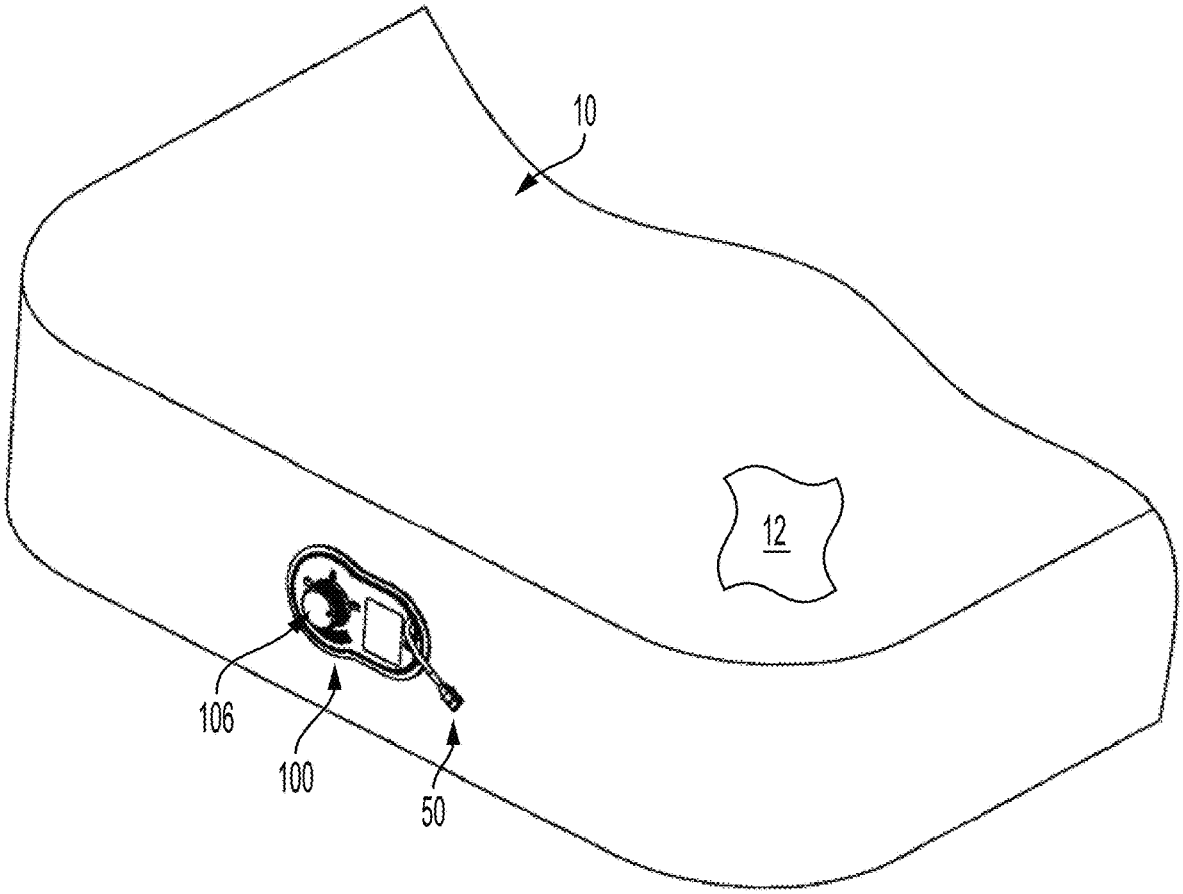
FIG. 2 illustrates a schematic view of the air pump assembly of FIG. 1 installed on an inflatable product.

Referring to FIGS. 1 to 18, an exemplary embodiment of an air pump assembly 100 is shown. Air pump assembly 100 includes an air pump 102 and a housing 120. Referring to FIG. 2, air pump assembly 100 may be received in an inflatable product 10 and be accessible from an exterior of the inflatable product 10. Inflatable product 10 is illustratively an inflatable mattress, but may take other forms including inflatable pools, inflatable toys, and other suitable inflatable products.

Figure 3:
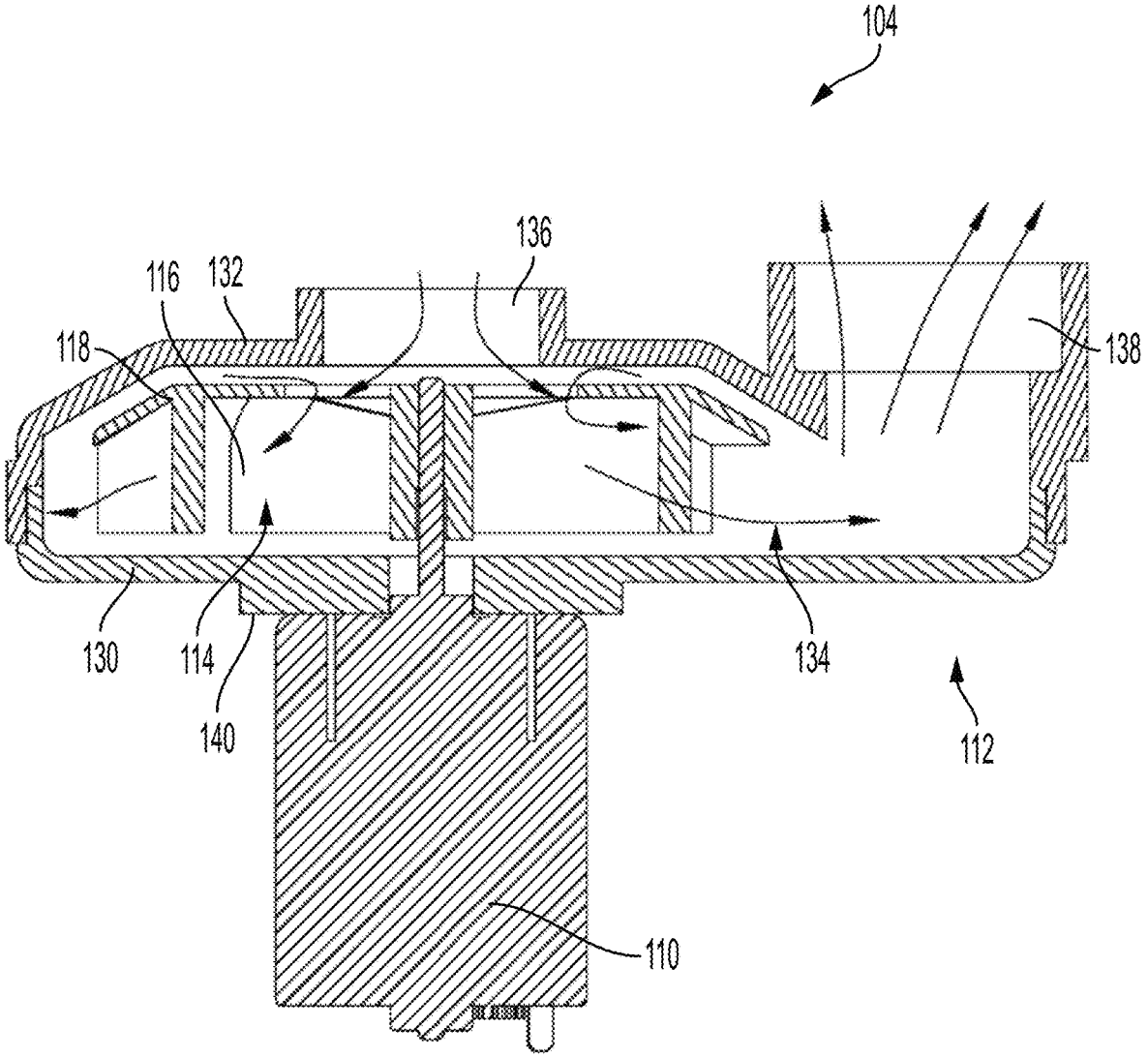
FIG. 3 illustrates an exemplary cross-sectional view of an impeller, a motor, and a pump housing that may be included as part of the air pump assembly of FIG. 1.

Referring to FIG. 3, air pump 102 includes a rotatable assembly 104 and an operator actuatable input, illustratively a rotating handwheel 106. Referring to FIG. 3, rotating assembly 104 includes a motor 110, a pump housing 112, and an impeller 114 including at least one blade 116. Pump housing 112 may include an upper pump housing 130 and a lower pump housing 132 which cooperate to form a cavity 134 in which impeller 114 is positioned. Lower pump housing 132 includes a first air vent 136 and a second air vent 138. Throughout this application first air vent 136 is referred to as an air inlet and second air vent 138 is referred to as an air outlet. This corresponds to an inflation operation of air pump 102 and during a deflation operation first air vent 136 functions as an air outlet and second air vent 138 functions as an air inlet.

Figure 12:
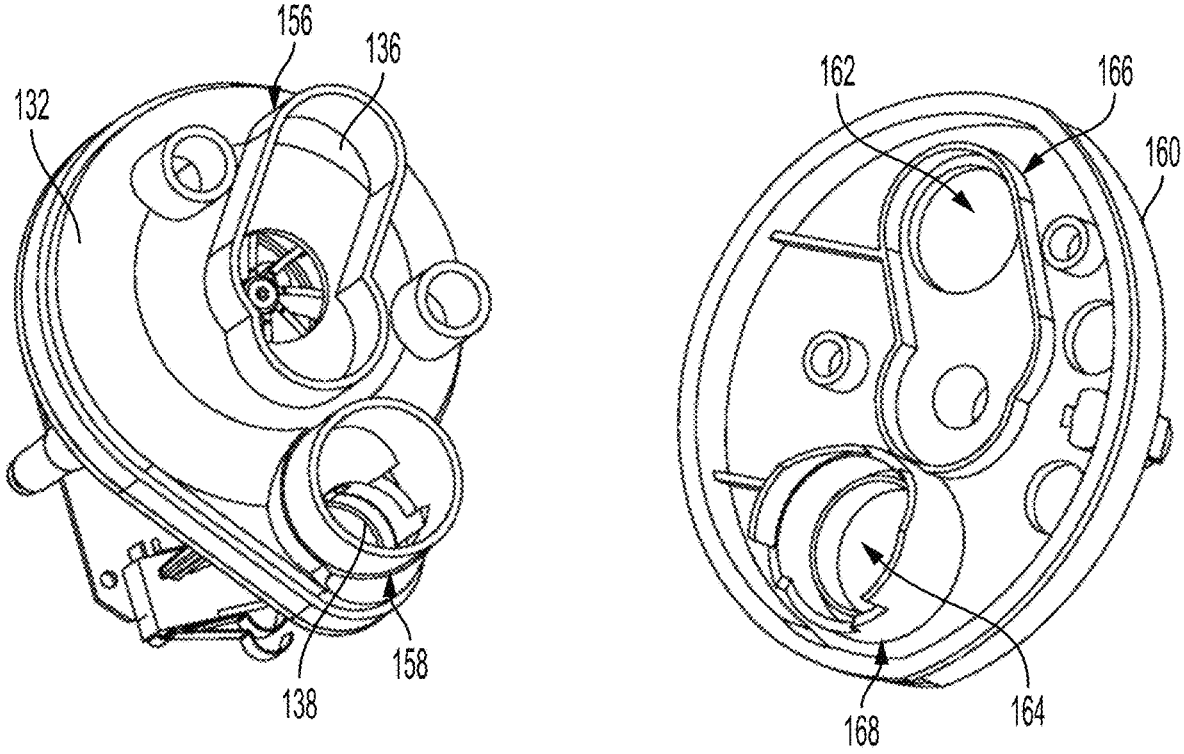
FIG. 12 illustrates an assembled pump housing and a rotary disc of the air pump assembly of FIG. 1.

Referring to FIG. 12, in embodiments, rotating assembly 104 further includes a rotary disc 160 having a first air vent 162 and a second air vent 164. Rotary disc 160 includes a wall boundary 166 which cooperates with a wall boundary 156 of lower pump housing 132 to form a fluid conduit through which first air vent 136 of lower pump housing 132 is in fluid communication with first air vent 162 of rotary disc 160. Rotary disc 160 further includes a wall boundary 168 which cooperates with a wall boundary 158 of lower pump housing 132 to form a fluid conduit through which second air vent 138 of lower pump housing 132 is in fluid communication with second air vent 164 of rotary disc 160. In embodiments, motor 110, upper pump housing 130, lower pump housing 132, and rotary disc 160 are connected in sequence from a top side 122 of housing 120 to a bottom side 124 of housing 120.

Motor 110 is fixed to an upper end surface 140 (see FIG. 3) of upper pump housing 130. Impeller 114 is arranged in the cavity 132 formed by upper pump housing 130 and lower pump housing 132.

Pump lower housing 132 of pump housing 112 and the rotary disc 160 form an airway switching device, wherein pump housing 112 and the rotary disc 160 are respectively provided with air inlets 136, 162 and air outlets 138, 164. The airway switch device can make the air inlets 136, 162 and the air outlets 138, 164 each respectively connected to the first vent hole 200 (see FIG. 14) at the bottom side 124 of the housing 120 to realize the functions of inflating and deflating the air pump.

Figure 6:
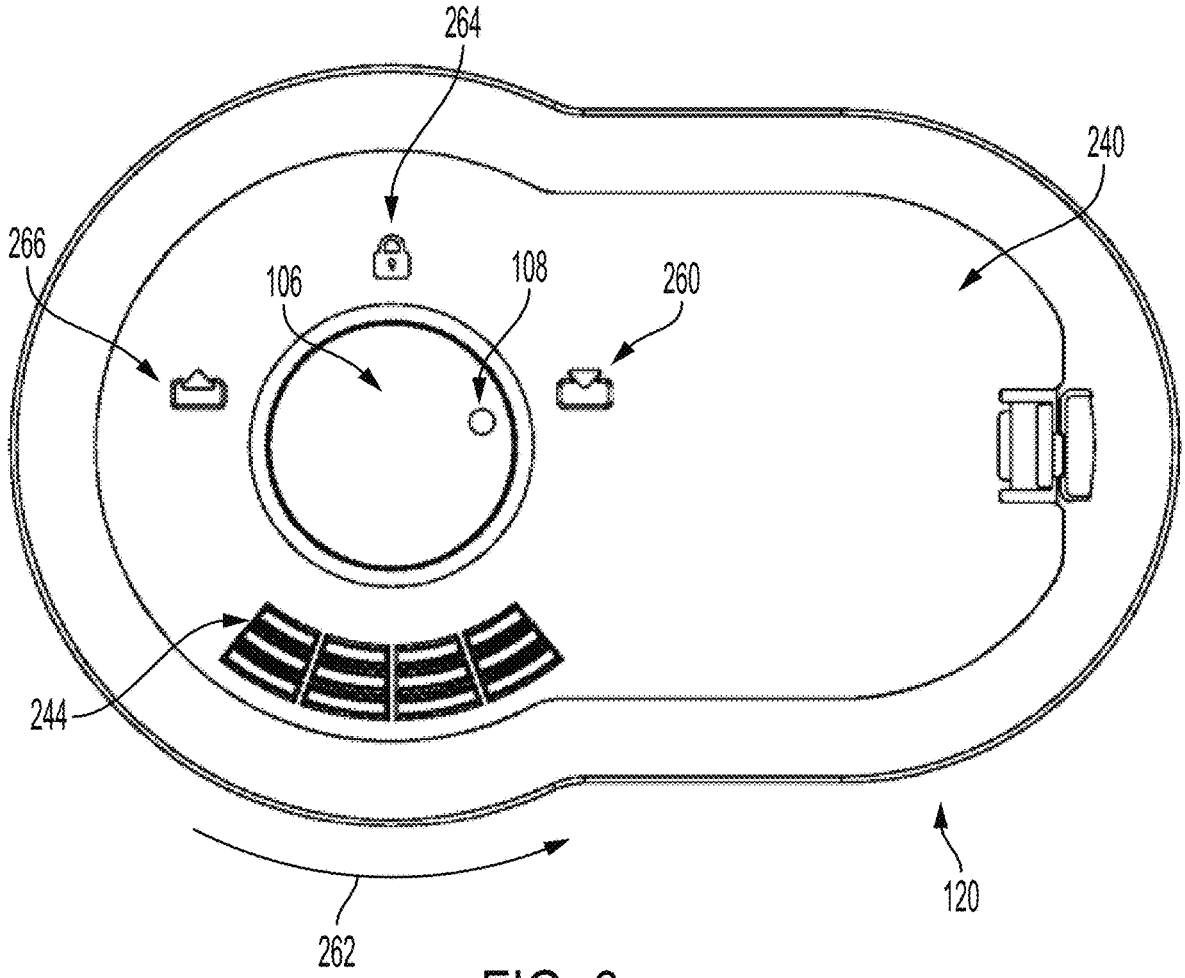
FIG. 6 illustrates a top view of the air pump assembly of FIG. 1 in an inflating state.
Figure 7:
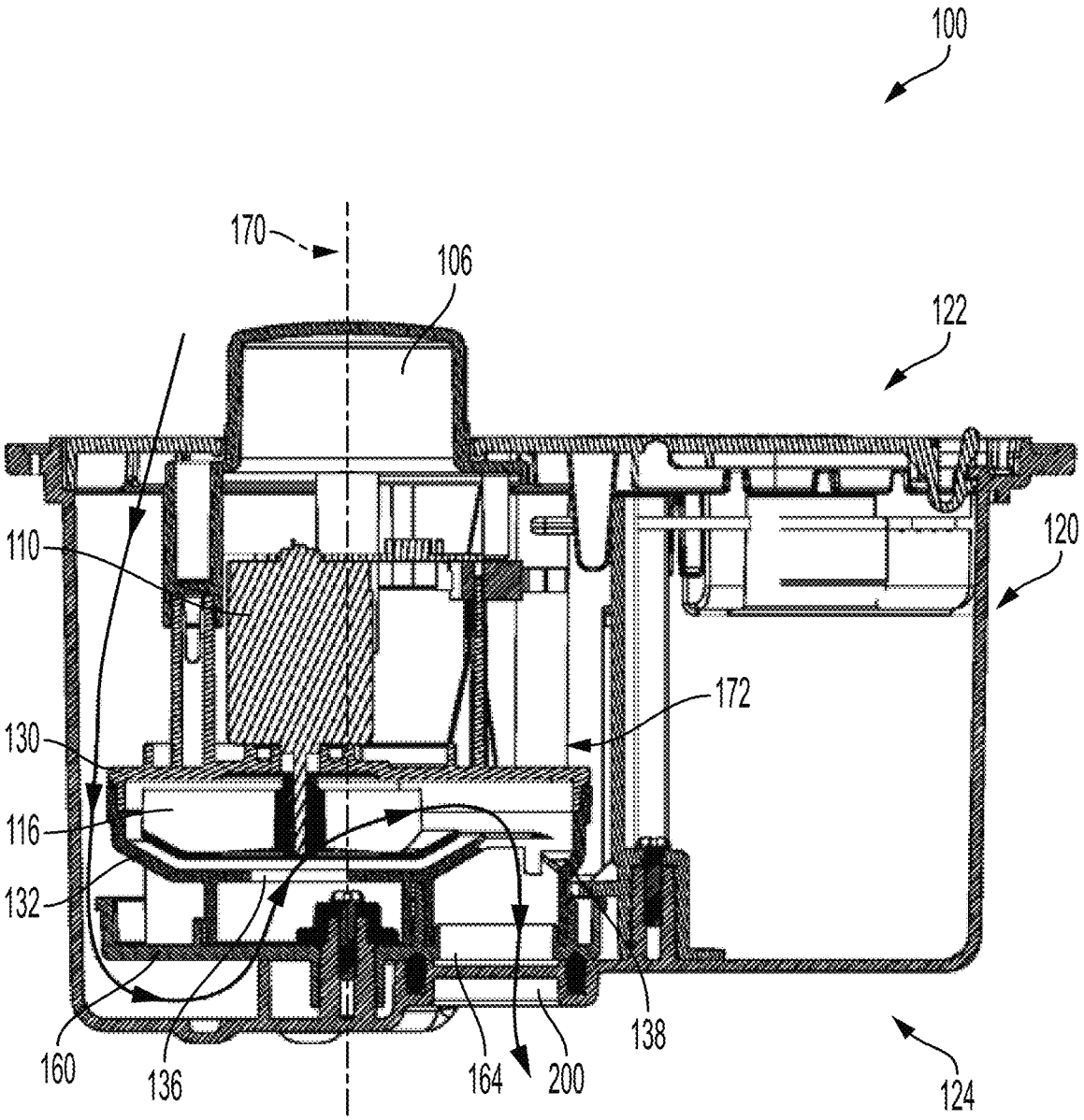
FIG. 7 illustrates a cross-sectional view of the air pump assembly of FIG. 1 in the inflating state of FIG. 6.
Figure 10:
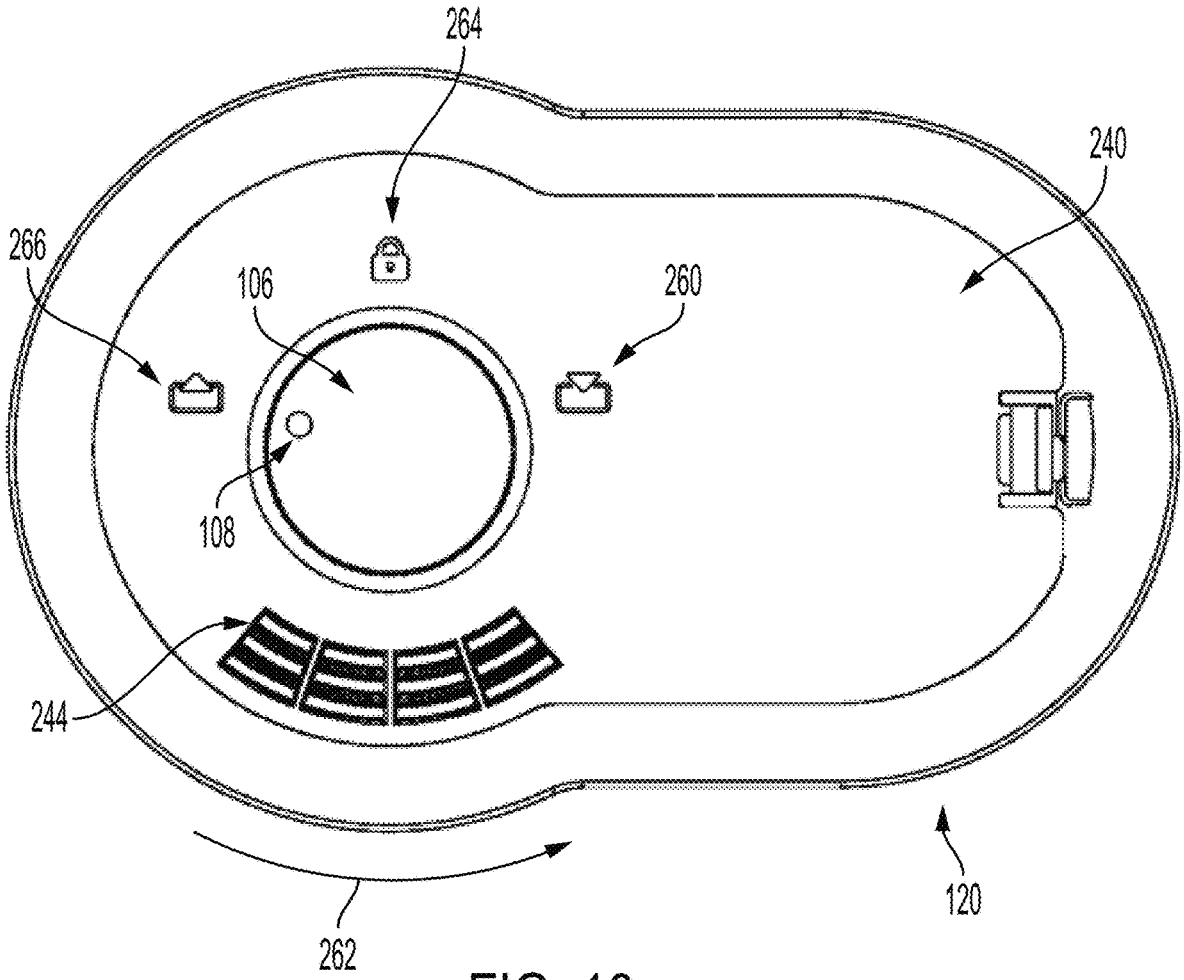
FIG. 10 illustrates a top view of the air pump assembly of FIG. 1 in a deflating state.
Figure 11:
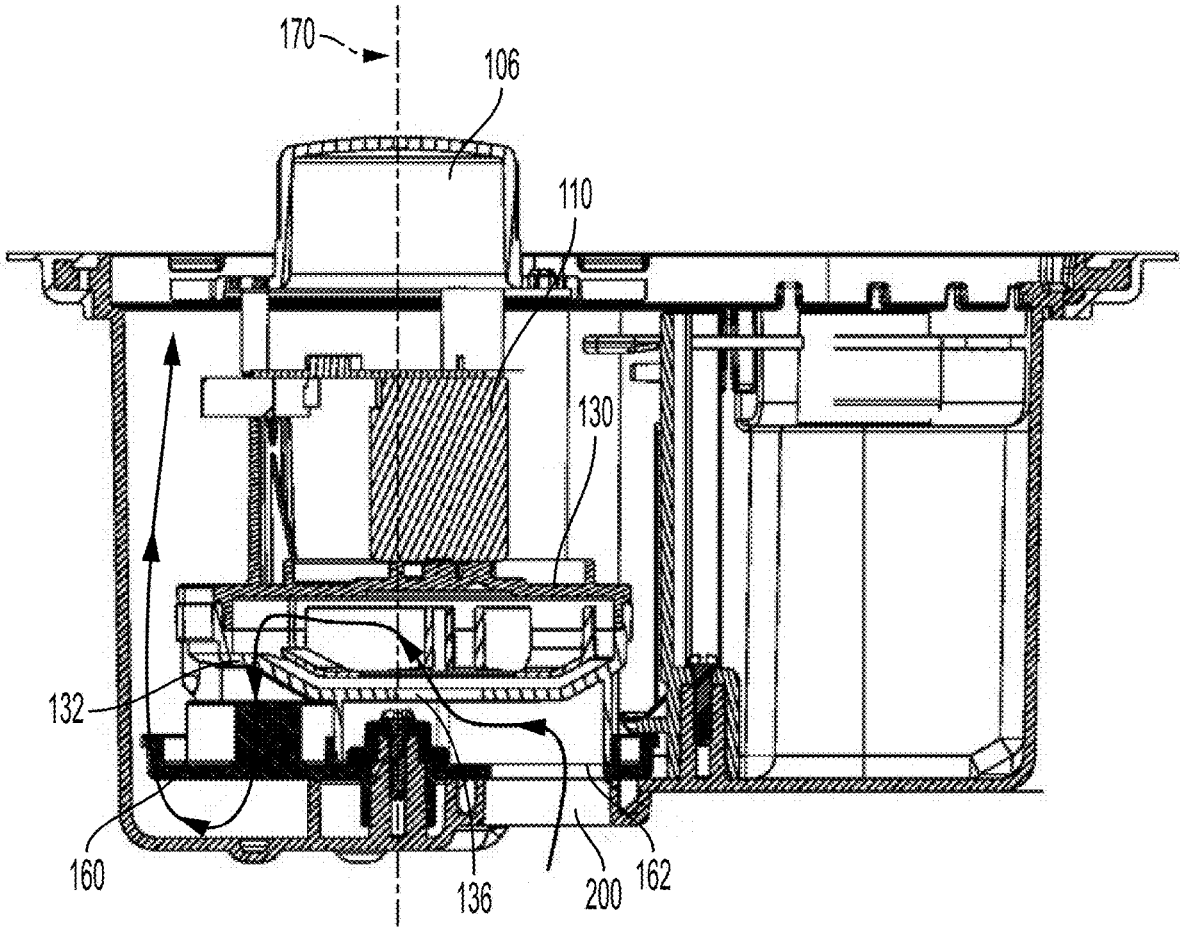
FIG. 11 illustrates a cross-sectional view of the air pump assembly of FIG. 1 in the deflating state of FIG. 10.

In the illustrated embodiment, motor 110, pump housing 112, and rotary disc 160 rotate as a unit 172 to connect either air inlets 136, 162 to first vent hole 200 of pump housing 112 in a deflation mode of air pump assembly 100 (see FIGS. 10 and 11) or air outlets 138, 164 to first vent hole 200 of pump housing 112 in an inflation mode of air pump assembly 100 (see FIGS. 6 and 7). As illustrated herein, unit 172 rotates about a vertical axis 170. Referring to FIGS. 7 and 11, in the inflation mode, motor 110 is generally positioned on a left side of vertical axis 170 and in a deflation mode is generally positioned on a right side of vertical axis 170. In the illustrated embodiment, rotating handwheel 106 is coupled to unit 172 to rotate with unit 172. In embodiments, rotating handwheel 106 is coupled to unit 172 through a linkage or drive mechanism, such as gears, and does not rotate as a unit with unit 172.

Figure 5:
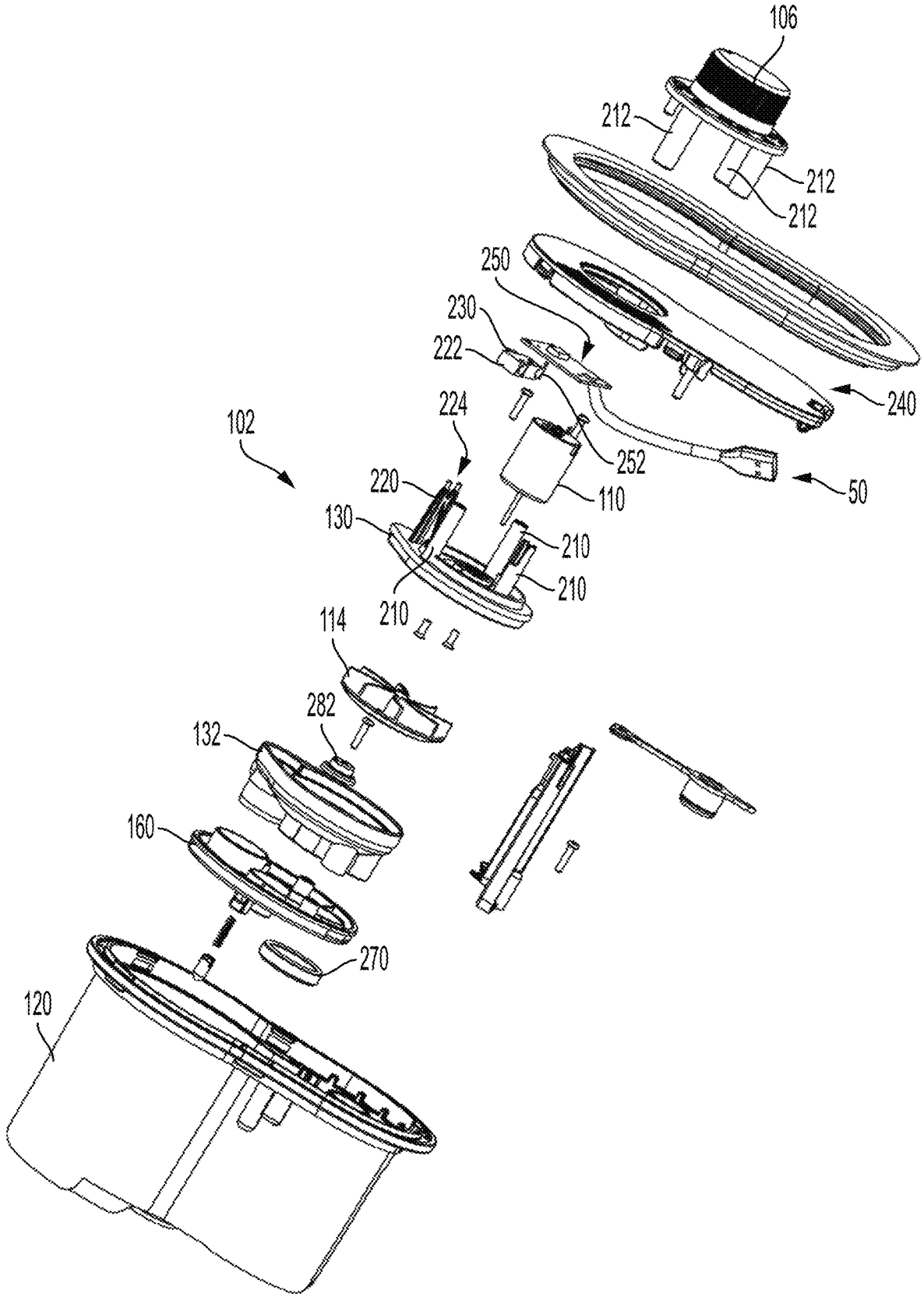
FIG. 5 illustrates an exploded view of the air pump assembly of FIG. 1.
Figure 13:
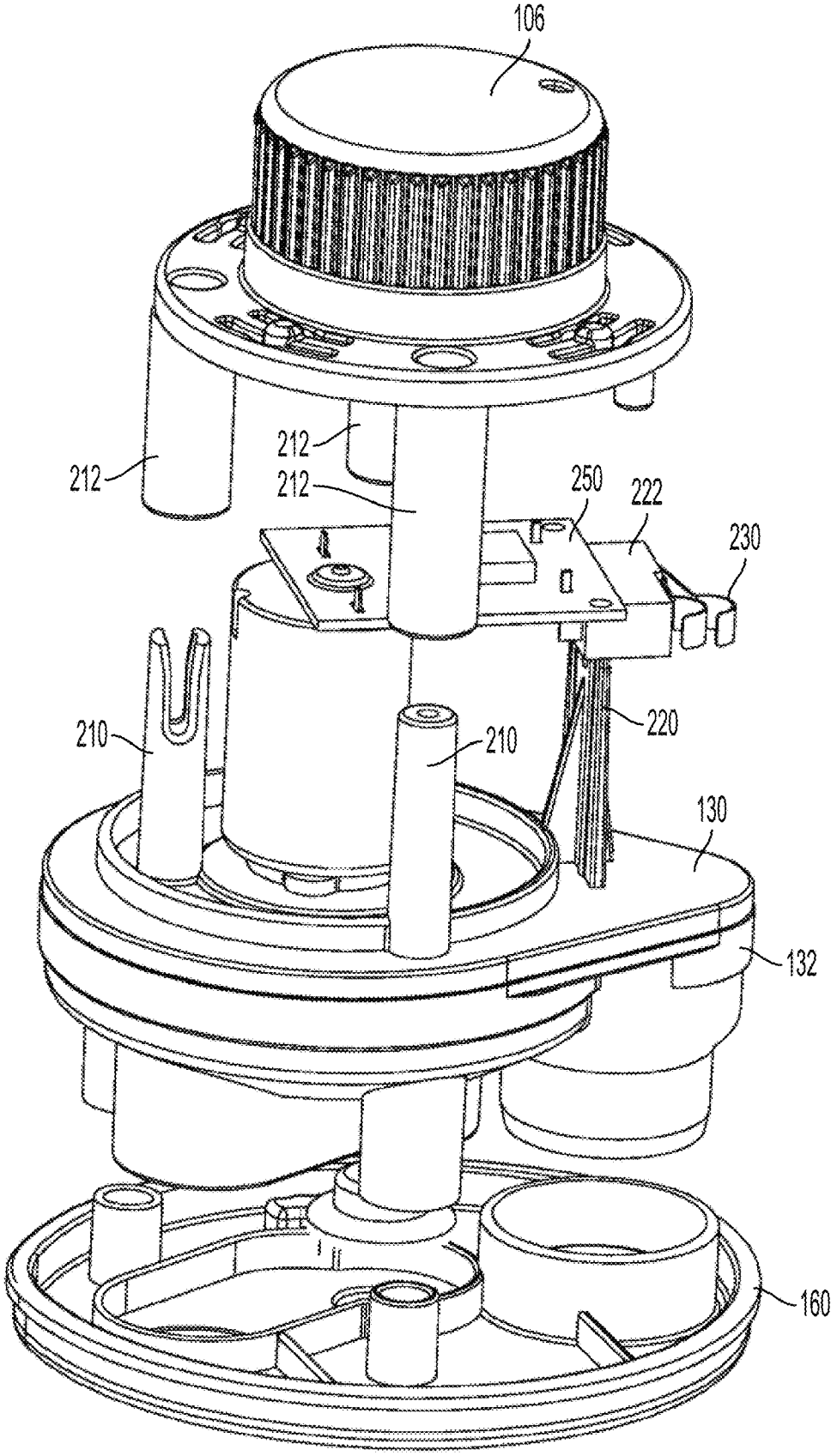
FIG. 13 illustrates an exploded view of a rotating assembly of the air pump assembly of FIG. 1.

Referring to FIGS. 5 and 13, in the illustrated embodiment, in order to realize that rotating handwheel 106 drives air pump 102 to rotate, an upper side 142 of the upper pump housing 130 is provided with a plurality of connecting columns 210 which align with a plurality of connecting columns 212 extending from a lower side 214 (see FIG. 13) of rotating handwheel 106. As shown in FIG. 7, a top of connecting columns 210 of upper pump housing 130 are received in a lower opening in connecting columns 212 of rotating handwheel 106. Rotating handwheel 106 and upper pump housing 130 are fixedly connected by bolts (not shown) or other suitable fasteners. Although the number of connecting columns 210 in FIG. 5 is three, other numbers (for example, 2, 4 or more) of connecting columns 210 can be set according to the size of the air pump to ensure the synchronous rotation and stable connection of rotating handwheel 106 and upper pump housing 130. Further, rotating handwheel 106 and upper pump housing 130 may further be fixedly connected by means other than a bolt connection, such as a buckle connection.

The upper side 142 of upper pump housing 130 is further provided with a column 220. A switch base 222 is coupled to column 220 through an opening 224 of column 220. A switch 230 is connected with the switch base 222. Switch 230 controls an operation of motor 110 and thus the operation of air pump assembly 100.

Figure 16:
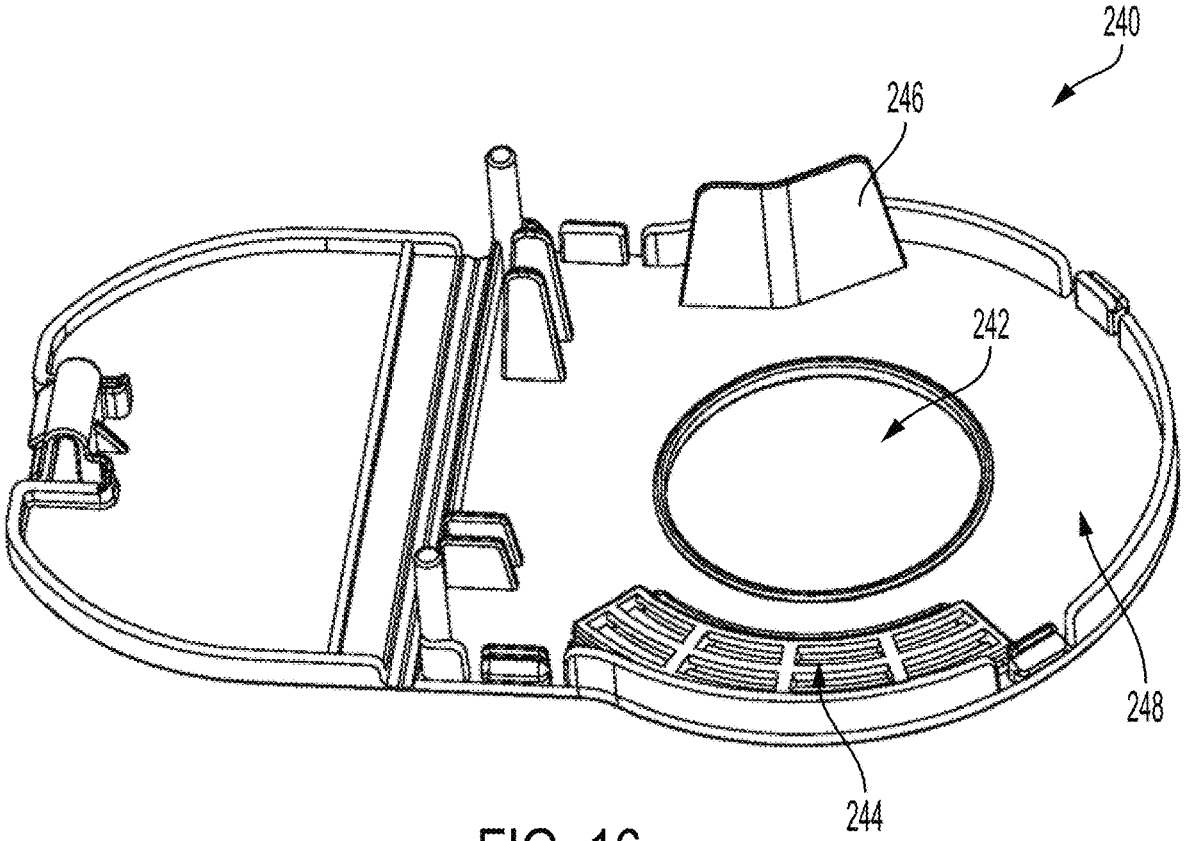
FIG. 16 illustrates a lower, perspective view of a cover of the housing of the air pump assembly of FIG. 1.

Referring to FIG. 16, a cover 240 is shown. Cover 240 is received by an opening in housing 120 and is secured to housing 120. Cover 240 includes an opening 242 through which rotating handwheel 106 extends and a plurality of vent openings 244 through which ambient air passes through cover 240, into pump housing 112, and out through first vent hole 200 of housing 120 into an interior 12 of inflatable product 10 in an inflation mode of air pump assembly 100 and air passes from interior 12 of inflatable product 10 through first vent hole 200 in housing 120, through pump housing 112, and through cover 240 in a deflation mode of air pump assembly 100. Cover 240 further includes a control plate 246 extending from a lower side 248 of cover 240.

Figure 8:
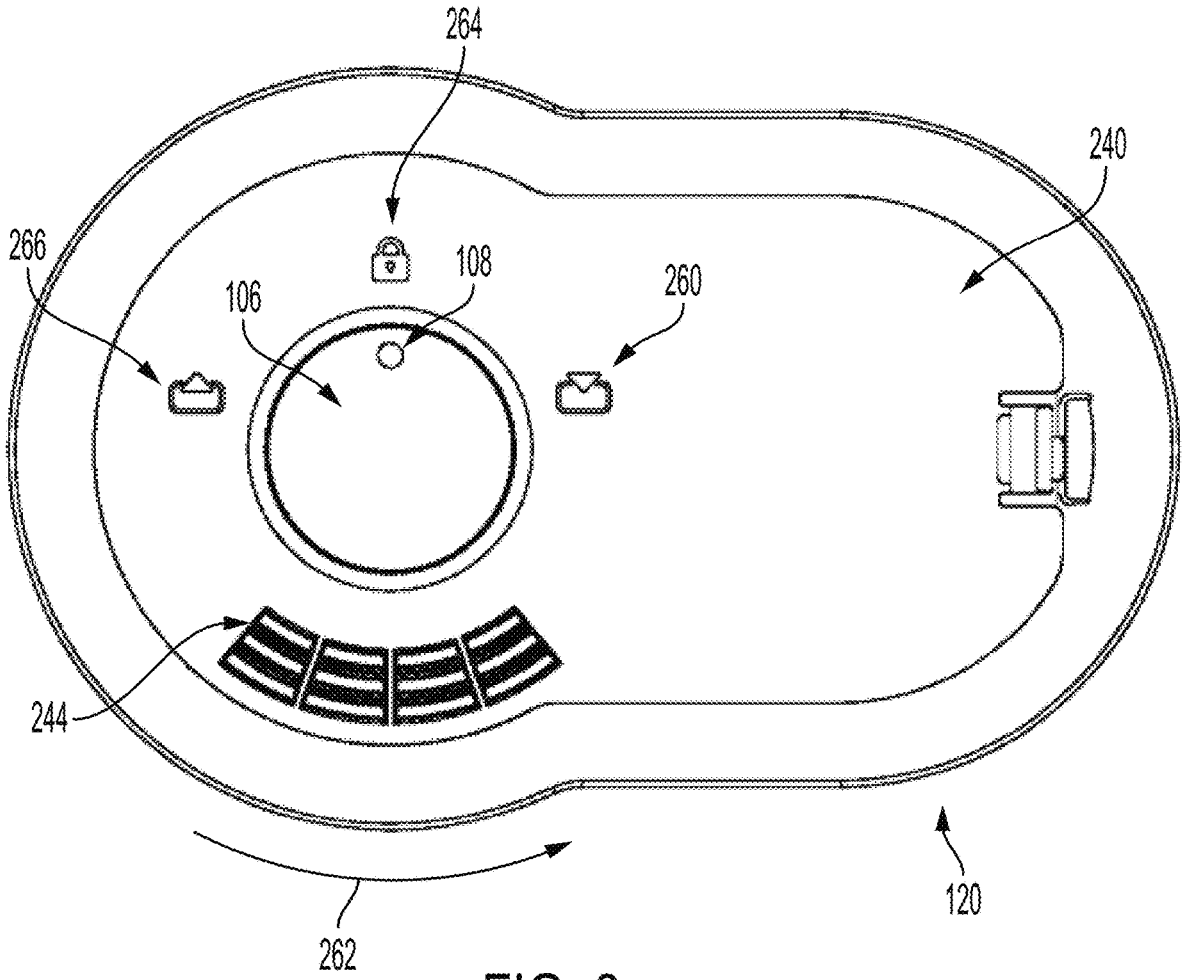
FIG. 8 illustrates a top view of the air pump assembly of FIG. 1 in a sealing state.
Figure 15:
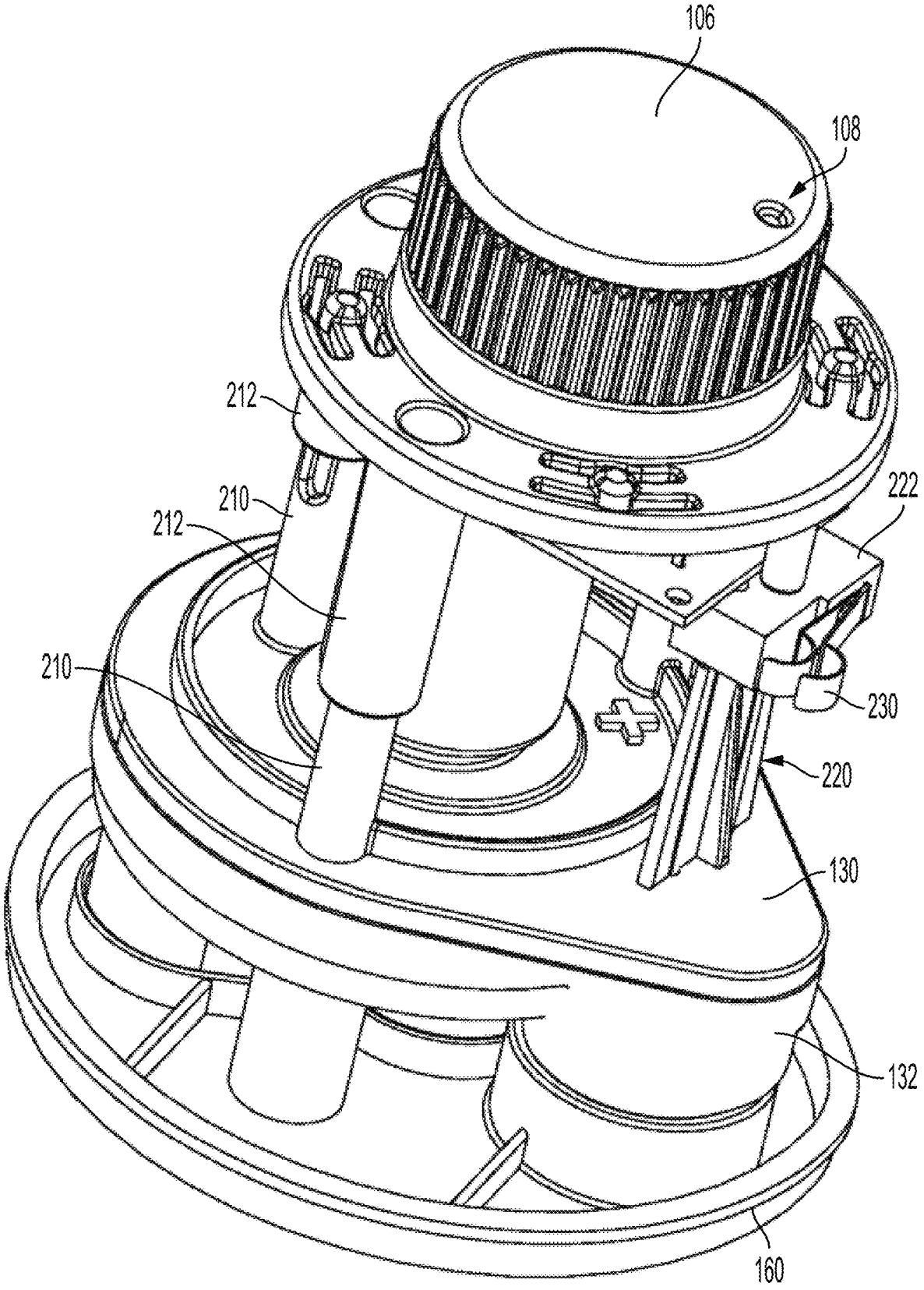
FIG. 15 illustrates an assembled view of the rotating assembly of FIG. 13 of the air pump assembly of FIG. 1.

Control plate 246 interacts with switch 230 to control the operation of motor 110. Referring to FIG. 15, rotating handwheel 106 includes an indicia 108 which is generally aligned with switch 230. Referring to FIGS. 6 and 7, when air pump assembly 100 is in an inflation mode indicia 108 is aligned with an inflation indicia 260 on an upper side 249 of cover 240 and switch 230 is not depressed by control plate 246 of cover 240. When switch is not depressed, the electronic circuitry on circuit board 250 supplies electricity to motor 110 to power rotation of motor 110 and hence impeller 114. As rotating handwheel 106 is rotated counterclockwise in direction 262, indica 108 comes into alignment with a sealing or off indica 264 corresponding to a sealed mode of air pump assembly 100 as shown in FIG. 8. When rotating handwheel 106 is in the position shown in FIG. 8, switch 230 contacts control plate 246 of cover 240 and is depressed. When switch 230 is depressed, the electronic circuitry on circuit board 250 cuts power to motor 110. As rotating handwheel 106 is further rotated counterclockwise in direction 262, indica 108 comes into alignment with a deflation indica 266 corresponding to a deflation mode of air pump assembly 100 as shown in FIG. 10. When rotating handwheel 106 is in the position shown in FIG. 10, switch 230 is not depressed by control plate 246 of cover 240 and the electronic circuitry on circuit board 250 supplies electricity to motor 110 to power rotation of motor 110 and hence impeller 114. As rotating handwheel 106 is rotated, rotating handwheel 106 drives upper pump housing 130 to rotate and the switch 230 to abut or separate from control plate 246 of cover 240, so that switch 230 can be opened or closed.

In embodiments, the switch base 222 is further conductively connected to the circuit board 250 through two conductive pins 252, and the circuit board 250 is connected to socket 50 in cover 240 (see FIG. 2). Socket 50 may be an USB interface or a Type-C interface through a wire, so that the air pump assembly 100 can be powered by a power bank, a car cigarette lighter conversion USB connector or other external power source. An advantage, among others, is that this makes it easier for users to find an external power supply that can be used in various environments, so that the inflatable product 10 can be used in various situations.

In the illustrated embodiment, a sealing ring 270 may be further provided. The sealing ring 270 is arranged at the connection between the vent hole 200 at the bottom of the inner cavity of the housing 120 and the rotary disc 160 to ensure the tightness of the air inlet 162 and the air outlet 164 of rotary disc 160 with the first vent hole 200 at the bottom of the inner cavity of housing 120, to prevent air from leaking from the gap between first air vent 162 of rotary disc 160 or second air vent 164 of rotary disc 160 and the vent hole 200 during inflating and deflating, which affects the inflation or the airtight maintenance effect after the inflation is completed. Although there is only one sealing ring 270 in the drawing, it should be realized that two or more sealing rings can be provided to increase the air-tight effect in certain applications. Housing 120 is provided with a ring groove 272 on the outer periphery of vent hole 200, and the sealing ring 270 is provided in ring groove 272 (see FIG. 14).

Figure 14:
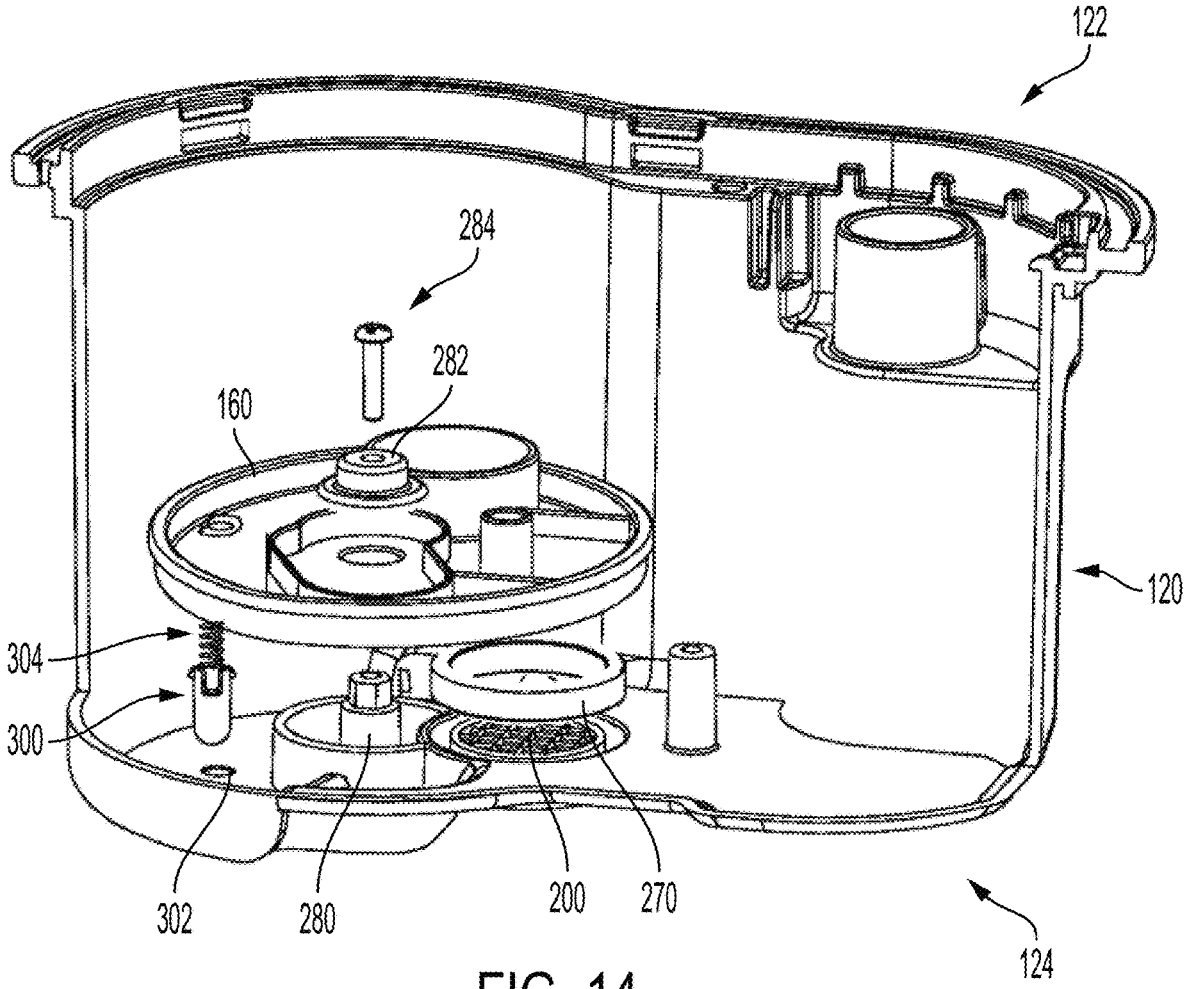
FIG. 14 illustrates an exploded view of the rotary disc, a pressure plate, fastener, and housing of the air pump assembly of FIG. 1.

Referring to FIG. 14, rotary disc 160 is further rotatably connected to a shaft 280 at the bottom of the housing 120 through a fastener 284 and a pressure plate 282. Rotary disc 160 is restricted by pressure plate 282, which ensures that rotary disc 160 rotates on the housing 120 without uneven compression due to the deformation of the seal ring 270. Through the pressure plate 282, the compression amount of the sealing ring 270 can be controlled more accurately to ensure sealing.

Figure 17:
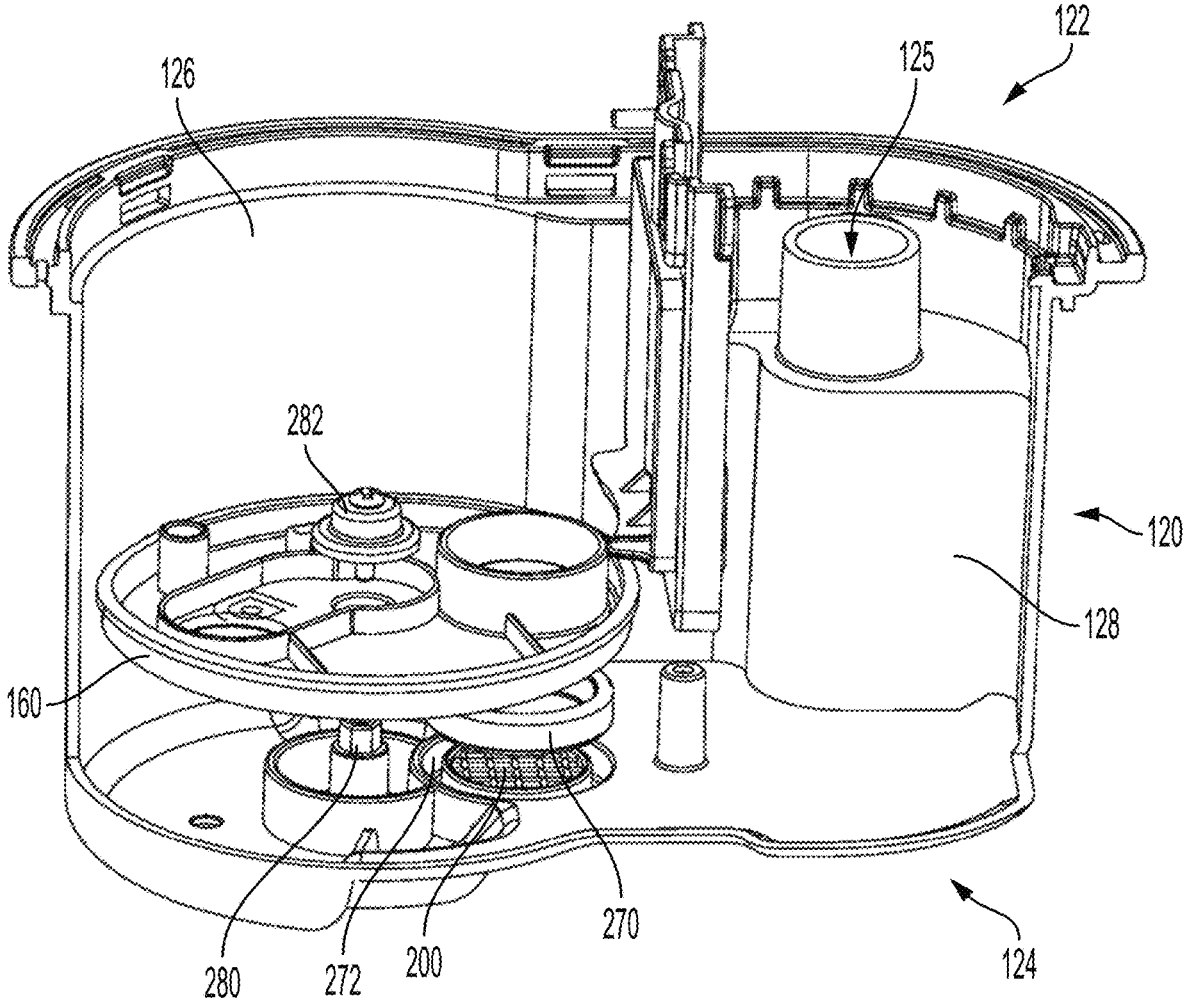
FIG. 17 illustrates an exploded view of the rotary disc, a pressure plate, fastener, and housing of the air pump assembly of FIG. 1.
Figure 18:
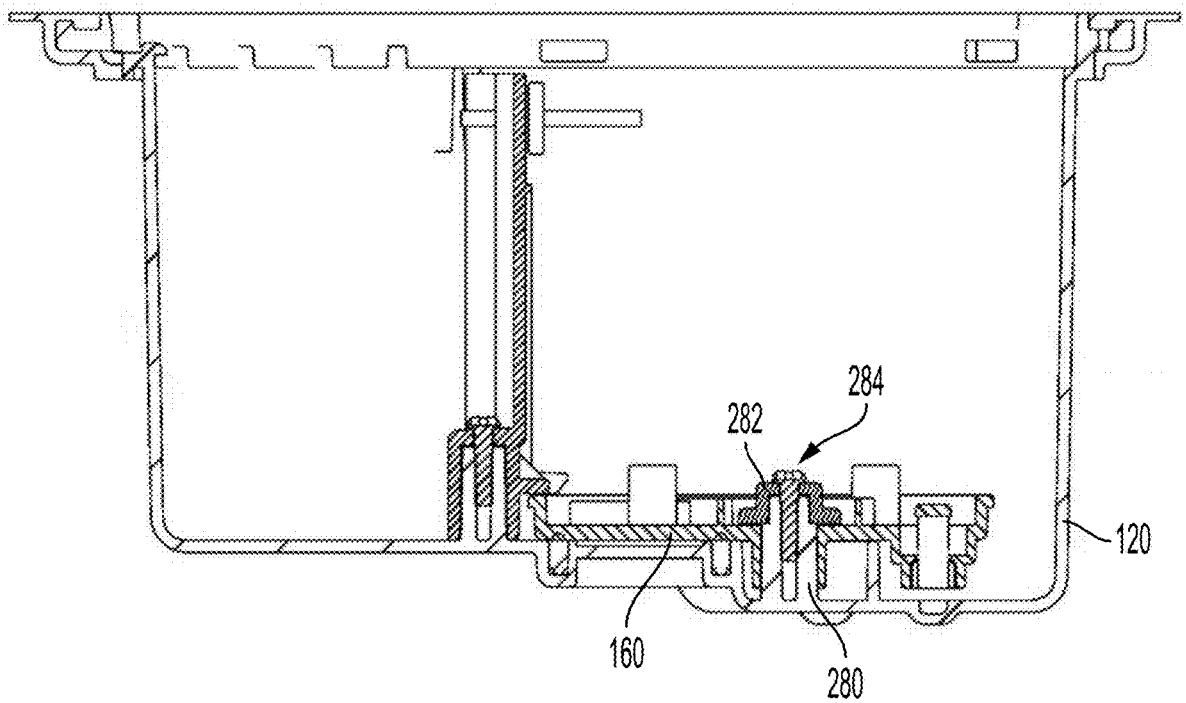
FIG. 18 illustrates a cross-sectional view of portions of the air pump assembly of FIG. 1.

The air pump 102 is detachably fixed to the housing 120. Referring to FIG. 17, the housing 120 comprises an air pump fixing cavity 126 and an accommodation cavity 128. The accommodating cavity 128 is arranged on one side of the air pump fixing cavity 126, and the bottom of the accommodating cavity 128 is provided with a second vent hole provided at the bottom of a fluid conduit 129. The second vent hole is provided with a check valve and a valve plug (not shown) which is biased to a closed position to retain air within interior 101 of air pump assembly 100. The cover 240 is detachably covering the opening of the accommodating cavity 128. The second vent hole at the bottom of the fluid conduit 129 of accommodating cavity 128 can further be used as a spare inflation port, and a manual inflation device can be used to inflate the inflatable product, which expands the use scenarios of the inflatable product.

When the inflation system of air pump assembly 100 is in use, an external power supply is connected through socket 50, such as an USB interface or a Type-C interface, and rotating handwheel 106 is turned to the inflation position wherein indicia 108 of rotating handwheel 106 aligns with inflation indicia 260 of cover 240 (see FIG. 6). At this time, control plate 246 of cover 240 and switch 230 are spaced apart and motor 110 is energized due to switch 230 not being depressed. Second air vent 164 of rotary disc 160 is connected to first vent hole 200 of housing 120. The motor 110 drives the blade 116 of impeller 114 to rotate causing external air to enter through openings 244 in cover 240 and passing downward to a location below upper pump housing 130, impeller 114, and lower pump housing 132. The air enters first air vent 162 and first air vent 136 of rotary disc 160 and lower pump housing 132 respectively, enters the cavity 134 formed by upper pump housing 130 and lower pump housing 132, exits through second air vent 138 and second air vent 164 of lower pump housing 132 and rotary disc 160 respectively, and ultimately the first vent 200 of housing 120 and enters into the interior 12 of the inflatable product 10 under the action of the blade 116 of impeller 114 to complete the inflation action of the inflatable product 10.

When the inflation system of air pump assembly 100 is in an off or sealed mode rotating handwheel 106 is rotated to the off or sealed position wherein indicia 108 of rotating handwheel 106 aligns with off indica 264 of cover 240 (see FIG. 8), control plate 246 of cover 240 and the switch 230 are contacting and control plate 246 depresses switch 230 and the motor stops working. At this time, both first air vent 162 and second air vent 164 of rotary disc 160 are in a disconnected state with the first vent 200 of the housing 120, the outside air is not connected to the interior 12 of the inflatable product 10, and the entire inflatable system is in a closed state. The internal air in interior 12 of inflatable product 10 cannot be discharged, and the air pressure in interior 12 of inflatable product 10 is maintained to ensure the normal use of the inflatable product 10.

Figure 9:
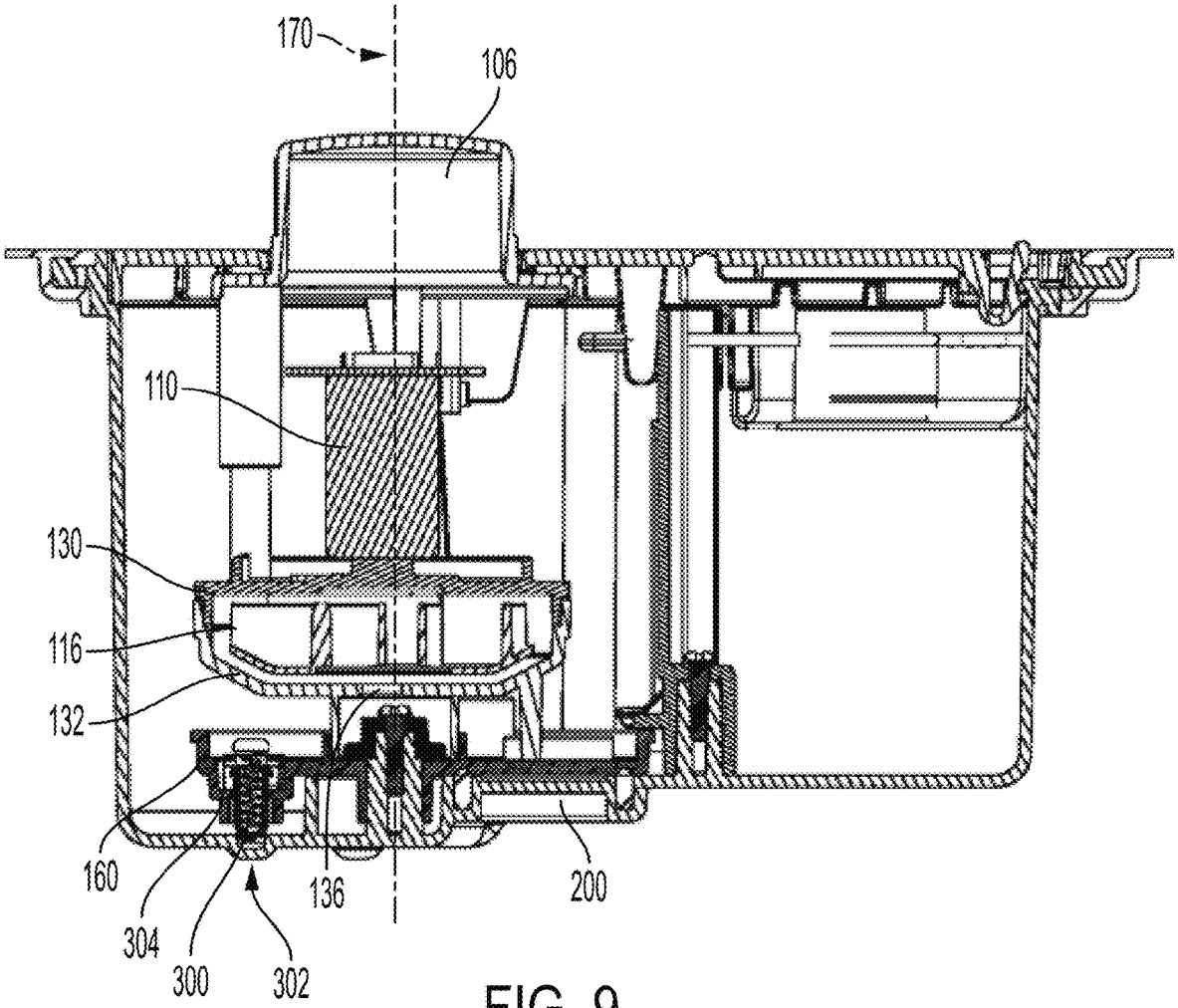
FIG. 9 illustrates a cross-sectional view of the air pump assembly in the sealing state of FIG. 8.

Air pump 102 is held in the off or sealed position due to a locator 300, illustratively a pin carried by rotary disc 160, being received in a recess 302 of housing 120 (see FIGS. 9 and 14). Locator 300 is spring biased towards bottom side 124 of housing 120 with a spring 304.

When the inflation system of air pump assembly 100 is in use, an external power supply is connected through socket 50, such as an USB interface or a Type-C interface, and rotating handwheel 106 is turned to the deflation position wherein indicia 108 of rotating handwheel 106 aligns with deflation indica 266 of cover 240 (see FIG. 10). At this time, control plate 246 of cover 240 and the switch 230 are spaced apart and motor 110 is energized due to switch 230 not being depressed. First air vent 162 of rotary disc 160 is connected to first vent hole 200 of housing 120. The first vent hole 200 of housing 120 is in a connected state. The motor 110 drives the blade 116 of impeller 114 to rotate, and the air inside the interior 12 of the inflatable product 10 passes through first vent hole 200 of housing 120, first air vent 162 of rotary disc 160, first air vent 136 of lower pump housing 132, second air vent 138 of lower pump housing 132, and second air vent 164 of rotary disc 160 under the action of the blade 116 of impeller 114 and finally discharged out of the housing 120 through vent openings 244 in cover 240 complete the deflation of the inflatable product.

By the rotation cooperation between lower pump housing 132 and rotary disc 160 and first vent hole 200 of housing 120, the airway switch inside the air pump is realized, thereby changing the inflating and deflating state of the air pump, so when the system is in use, an advantage, among others, is the air pump 102 can inflate and deflate the inflatable product 10 without dismantling or reinstalling, which greatly improves the consumer experience.

Figure 4:
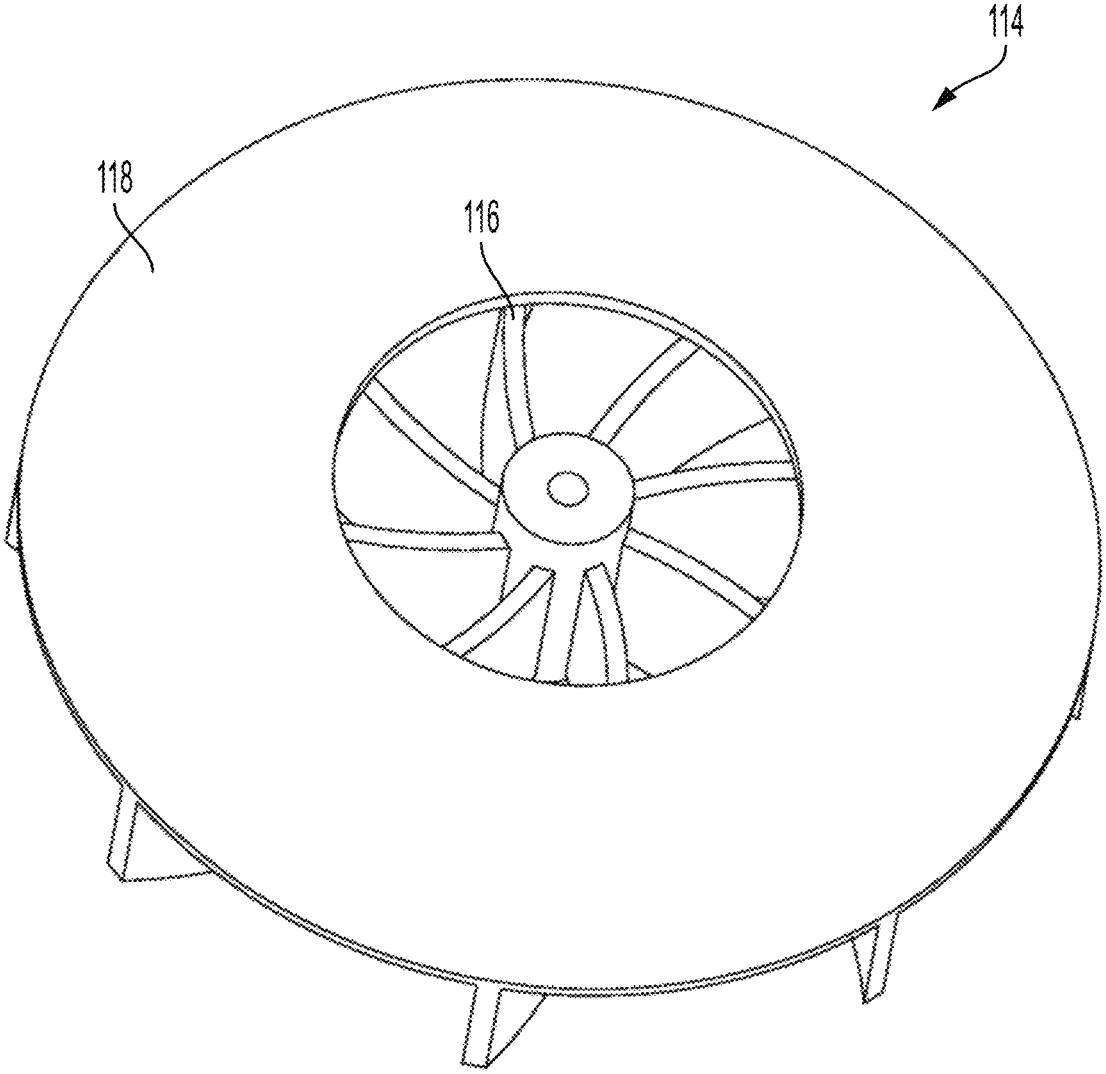
FIG. 4 illustrates a perspective view of an impeller of the air pump assembly of FIG. 1.

Referring to FIG. 4, the side of the impeller 114 facing away from motor 110 is arranged with a circular ring cover plate 118 along the circumferential direction. An inner ring of the circular ring cover plate 118 is aligned with the air inlet 136 of the air pump 102. The circular ring cover plate 118 is moved up to the air inlet surface of the blade 116 of impeller 114, thereby increasing the sealing of the air inlet of the blade 116 of impeller 114, so that the air at the inlet and outlet is not easily channeling, which improves the efficiency and the production process is simple.

Embodiment 2

Figure 19:
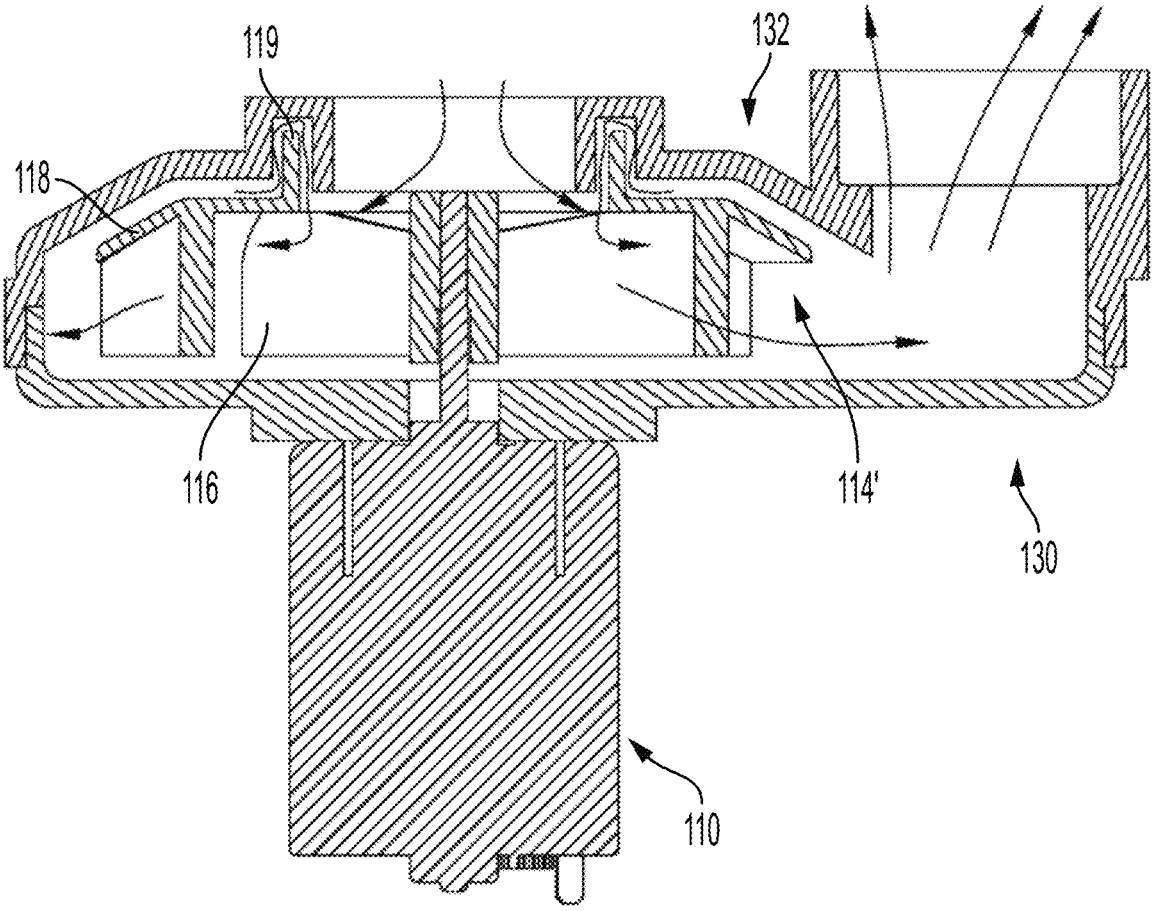
FIG. 19 illustrates a cross-sectional view of another exemplary impeller and pump housing combination for the air pump assembly of FIG. 1.
Figure 20:
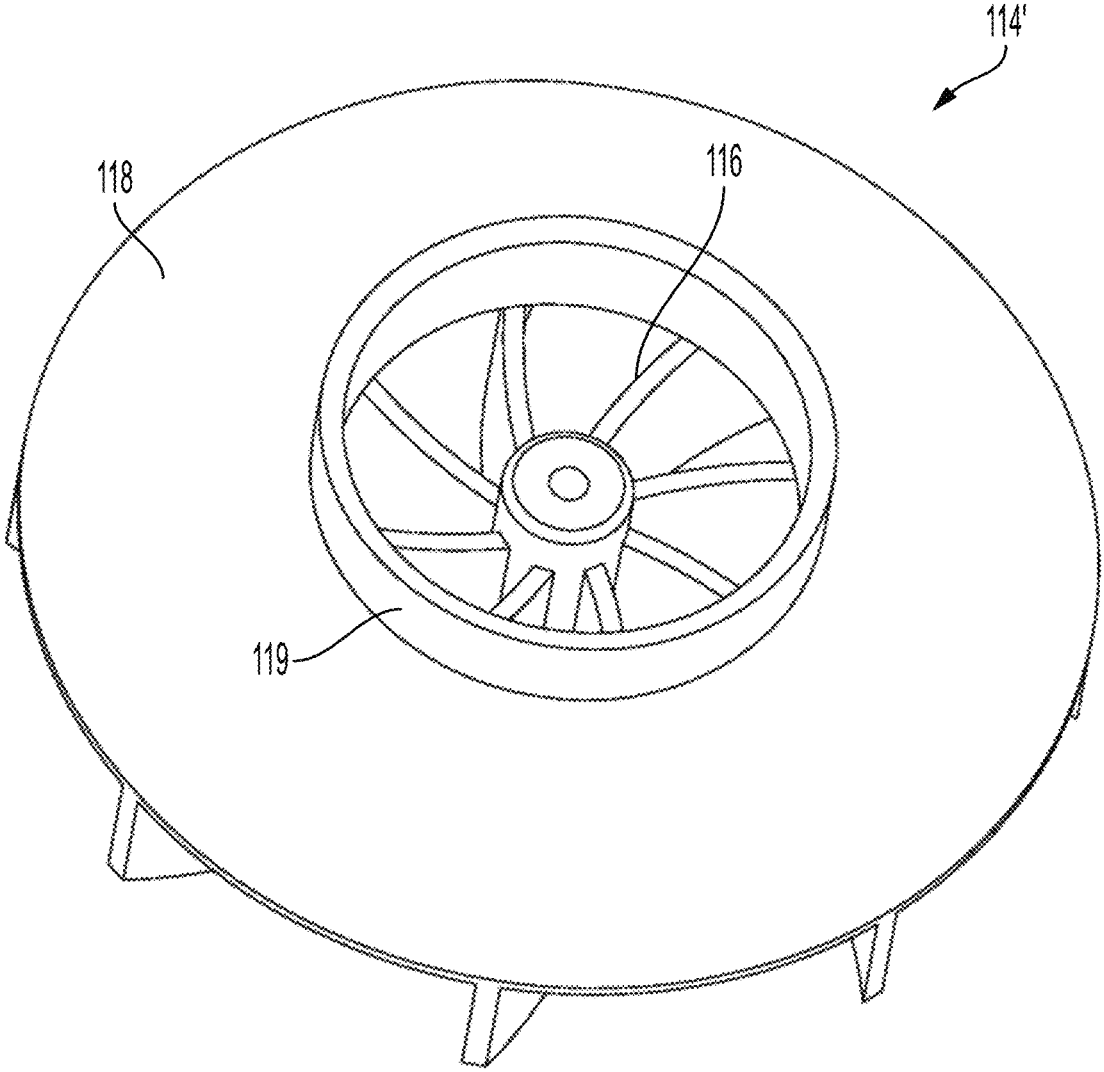
FIG. 20 illustrates a perspective view of the impeller of FIG. 19.

Referring to FIGS. 19-20, another exemplary embodiment of air pump assembly 100 is shown with an impeller 114'. The difference between this embodiment and embodiment 1 is that the inner ring of the circular ring cover plate 118 extends a circle of baffle 119 along the circumferential direction, and the baffle 119 extends in the direction away from the motor 110 along the axial direction of the blade 116 of impeller 114'. In this way, the air-tightness of the air inlet can be further improved.

Embodiment 3

Figure 21:
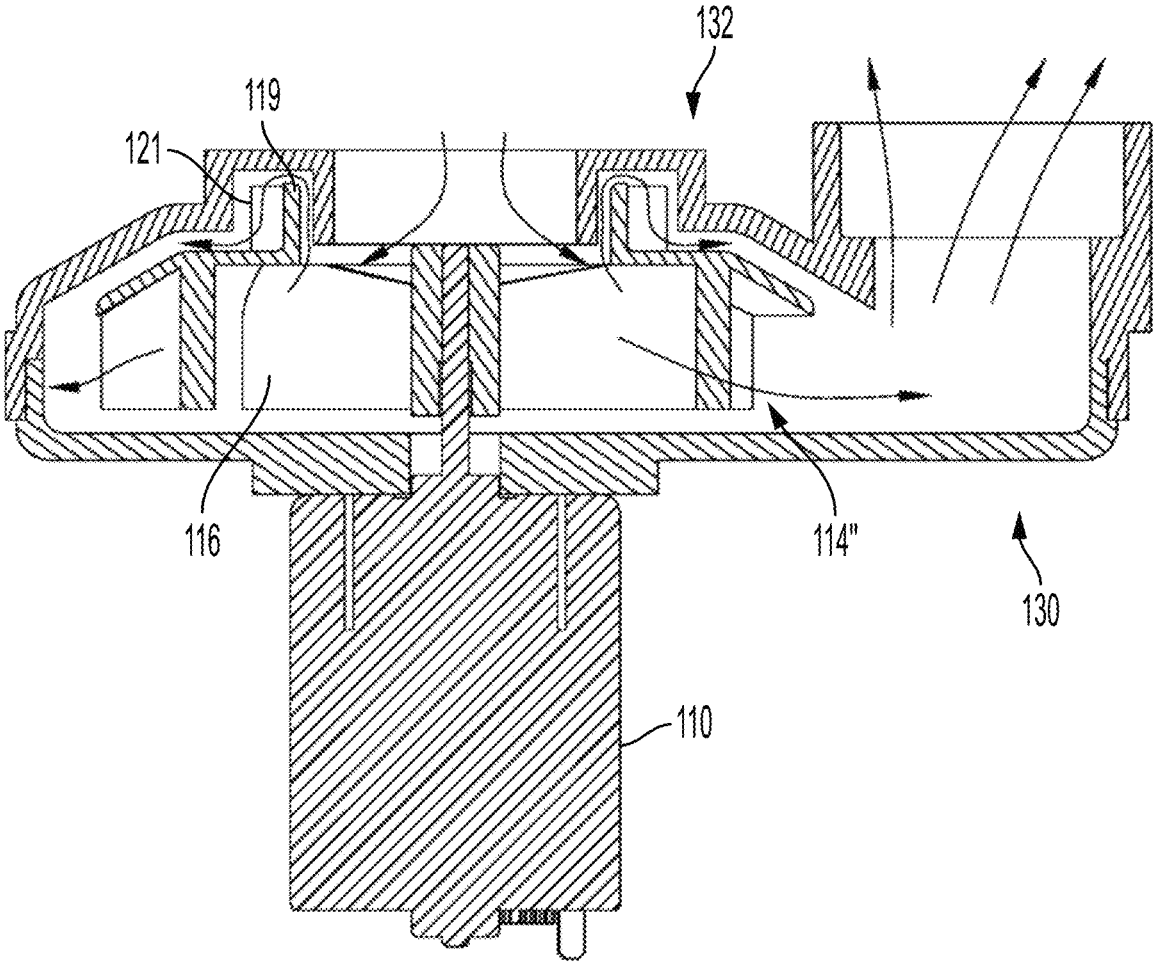
FIG. 21 illustrates a cross-sectional view of a further exemplary impeller and pump housing combination for the air pump assembly of FIG. 1.
Figure 22:
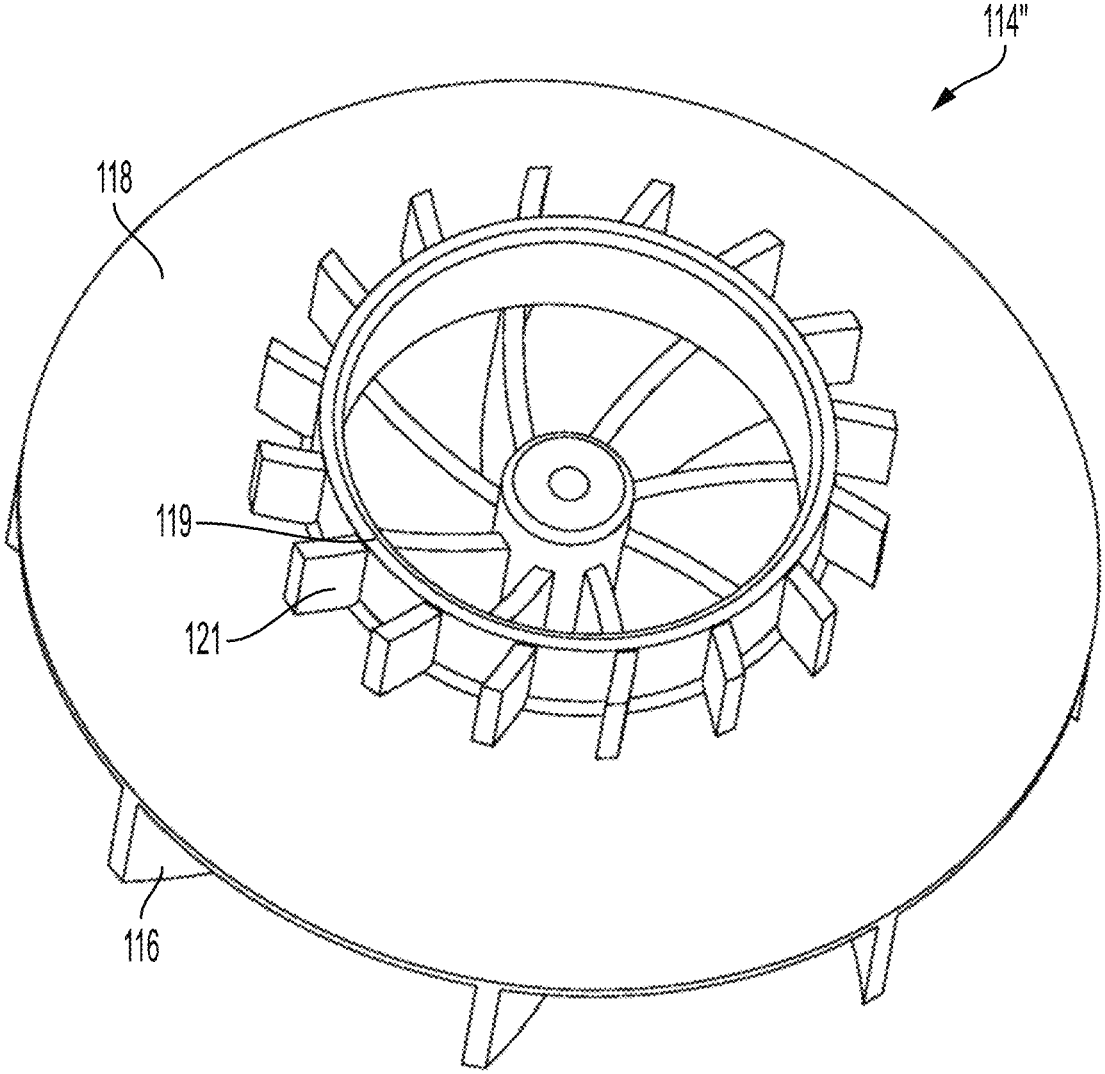
FIG. 22 illustrates a perspective view of the impeller of FIG. 21.

With reference to FIGS. 21-22, another exemplary embodiment of air pump assembly 100 is shown with an impeller 114". The difference between this embodiment and the embodiment 2 is that the side of the baffle 119 away from the blade 116 in the axial direction is provided with leak-proof attachment blades 121, and the leak-proof attachment blades 121 are arranged with interval along the circumferential direction of the baffle 118.

EXAMPLES

Example 1. An air pump assembly 100 for an inflatable product 10 having an interior 12 is provided. The air pump assembly 100 may comprise a housing 120 having a vent hole 200 in fluid communication with the interior 12 of the inflatable product 10, a cover 240 coupled to the housing, and a rotatable assembly 104 supported by the housing 120. The cover 240 may include a plurality of vent openings 244. The rotatable assembly 104 may comprise a pump housing 112 having a first air vent 136 and a second air vent 138, an impeller 114 positioned in the pump housing, and a motor 110 operatively coupled to the impeller to drive a rotation of the impeller 114. The rotatable assembly 104 being rotatable to a first position wherein air flows from the first air vent 136 of the pump housing 112 to the second air vent 138 of the pump housing 112 and through the vent hole 200 in the housing 120 into the interior 12 of the inflatable product 10 and a second position wherein air flows from the interior 12 of the inflatable product 10 through the vent hole 200 in the housing 120 into the first air vent 136 of the pump housing 120 to the second air vent 138 of the pump housing 120.

Example 2. The air pump assembly 100 of claim Example 1, wherein the motor 110 may maintain an orientation relative to each of the first air vent 136 of the pump housing 112 and the second air vent 138 of the pump housing 112 when the rotatable assembly 104 is in both the first position and the second position.

Example 3. The air pump assembly 100 of any one of Examples 1 and 2, wherein the rotatable assembly 104 may further include a rotating handwheel 106 which extends through an opening in the cover 240.

Example 4. The air pump assembly 100 of Example 3, wherein the motor 110 may be captured between the rotating handwheel 106 and the pump housing 112.

Example 5. The air pump assembly 100 of Example 4, wherein the rotating handwheel 106 may maintain an orientation relative to each of the first air vent 136 of the pump housing 112 and the second air vent 138 of the pump housing 112 when the rotatable assembly 104 is in both the first position and the second position.

Example 6. The air pump assembly 100 of any one of Examples 1-5, wherein the rotatable assembly may further include a rotary disc 160, the rotary disc 160 being positioned between the pump housing 112 and the vent hole 200 of the housing 120.

Example 7. The air pump assembly 100 of Example 6, wherein the rotary disc 160 may include a first air vent 162 and a second air vent 164. The first air vent 162 of the rotary disc 160 may communicate air to the first air vent 136 of the pump housing 112 when the rotatable assembly 104 is in the first position and the first air vent 162 of the rotary disc 160 may receive air from the first air vent 136 of the pump housing 112 when the rotatable assembly 104 is in the second position.

Example 8. The air pump assembly 100 of Example 7, wherein the rotating handwheel 106 may maintain an orientation relative to the rotary disc 160 when the rotatable assembly 104 is in both the first position and the second position.

Example 9. The air pump assembly 100 of any one of Examples 6-8, wherein a sealing ring 270 may be positioned between the rotary disc 160 and the housing 120 and about the vent hole 200 in the housing 120.

Example 10. The air pump assembly 100 of any one of Examples 6-9, wherein a pressure plate 282 may couple the rotary disc 160 to the housing 120.

Example 11. The air pump assembly 100 of any one of Examples 1-10, wherein the impeller 114 may include a circular ring cover plate 118 having a central opening and at least one blade 116 coupled to the circular ring cover plate 118.

Example 12. The air pump assembly 100 of Example 11, wherein the impeller 114 may further comprise a baffle 119 extending from the circular ring cover plate 118 in a first direction, the at least one blade 116 extending from the circular ring cover plate 118 in a second direction, the second direction being opposite the first direction.

Example 13. The air pump assembly 100 of Example 12, wherein the baffle 119 may be received in a recess in the pump housing 112.

Example 14. The air pump assembly 100 of any one of Examples 12 and 13, wherein the impeller 114 may further comprise at least one attachment blade 121 extending from the baffle 119.

Example 15. The air pump assembly 100 of any one of Examples 1-14, wherein the rotatable assembly 104 may further includes a circuit board 250 operatively coupled to the motor 110 and a switch 230 operatively coupled to the circuit board 250 to control operation of the motor 110.

Example 16. The air pump assembly 100 of Example 15, wherein the cover 240 may include a control plate 246 which cooperates with the switch 230 to control operation of the motor 110.

Example 17. An air pump assembly 100 for an inflatable product 10 is provided. The air pump assembly 100 may comprise a housing 100 and an air pump 102 positioned in the housing 100. The air pump 102 may comprise a rotating assembly 104 including a motor 110 and an impeller 114. The impeller 114 may include a blade 116 and a circular ring cover plate 118 may be arranged along a circumferential direction on a side of the blade 116 away from the motor 110. An inner ring of the circular ring cover plate 118 may be an air inlet of the air pump 102. The housing 120 may be provided with a socket 50 for connecting with an external power source. The socket may be a USB interface or a Type-C interface.

Example 18. The air pump assembly 100 for an inflatable product 10 according to Example 17, wherein the inner ring of the circular ring cover plate 118 may extend a circle of baffle 119 along the circumferential direction and the baffle 119 may extend away from the motor 110 along the axial direction of the blade 116.

Example 19. The air pump assembly 100 for an inflatable product 10 according to Example 18, wherein a side of the baffle 119 away from an axial direction of the blade 116 may be provided with a plurality of leak-proof attachment blades 121. The leak-proof attachment blades 121 may be arranged with interval along the circumferential direction of the baffle 119.

Example 20. The air pump assembly 100 for an inflatable product 10 according to Example 17, wherein the external power source may be one of a USB adapter, a USB cigarette lighter or a USB rechargeable battery.

Example 21. The air pump assembly 100 for an inflatable product 10 according to any one of Examples 17 to 20, wherein the rotating assembly 104 may further comprise a rotating handwheel 106, an upper pump housing 130 and an airway switch device. The rotating handwheel 106, the motor 110, the upper pump housing 130, and the airway switch device may be sequentially connected from a top 122 of the housing 120 to a bottom 124 of the housing 120. The bottom 124 of the housing 120 may be provided with a first vent hole 200. The first vent hole 200 may be connected to a vent hole 162, 164 of the airway switch device.

Example 22. The air pump assembly 100 for an inflatable product 10 according to Example 21, wherein the airway switch device may be provided with an air inlet 162 and an air outlet 164, and the airway switch device may be arranged that when the rotating assembly 104 rotates, the air inlet 162 and the air outlet 164 can respectively be connected to the first vent hole 200.

Example 23. The air pump assembly 100 for an inflatable product 10 according to Example 22, may further comprise a switch 230. The switch 230 may be fixed to the rotating assembly 104. The housing 120 may be provided with a control plate 246 that cooperates with the switch 230. A rotation of the rotating assembly 104 may drive the switch 230 to rotate; the switch 230 contacts with the control plate 246 or separates from the control plate 246.

Example 24. The air pump assembly 100 for an inflatable product 10 according to Example 23, wherein the switch 230 may be further provided with a pin 252 electrically connected to a circuit board 250, and the circuit board 250 is connected to the socket 50.

Example 25. The air pump assembly 100 for an inflatable product 10 according to Example 21, wherein the bottom 124 of the housing 120 may be provided with a shaft 280 that is connected with the airway switch device.

Example 26. The air pump assembly 100 for an inflatable product 10 according to Example 25, wherein the airway switch device may comprise a rotary disc 160 and a lower pump housing 132. The rotary disc 160 may be connected to the shaft 280 of the housing 120 through a pressure plate 282. A sealing ring 270 may be arranged on an outer circumference of the first vent hole 200 and arranged in a groove 272 in the housing 120.

It will be apparent to those skilled in the art that various modifications and variation can be made in the present disclosure without departing from the spirit or scope of the disclosure. Thus, it is intended that the present disclosure cover the modifications and variations of this disclosure provided they come within the scope of the appended claims and their equivalents.

What is claimed is:

1. An air pump assembly for an inflatable product having an interior, comprising:

a housing having a vent hole in fluid communication with the interior of the inflatable product;

a cover coupled to the housing, the cover including a plurality of vent openings; and a rotatable assembly supported by the housing, the rotatable assembly comprising a pump housing having a first air vent and a second air vent;

an impeller positioned in the pump housing;

a motor operatively coupled to the impeller to drive a rotation of the impeller; and a rotary disc positioned between the pump housing and the vent hole of the housing;

wherein the rotatable assembly being rotatable to a first position wherein air flows from the first air vent of the pump housing to the second air vent of the pump housing and through the vent hole in the housing into the interior of the inflatable product and a second position wherein air flows from the interior of the inflatable product through the vent hole in the housing into the first air vent of the pump housing to the second air vent of the pump housing.

2. The air pump assembly of claim 1, wherein the motor maintains an orientation relative to each of the first air vent of the pump housing and the second air vent of the pump housing when the rotatable assembly is in both the first position and the second position.

3. The air pump assembly of claim 1, wherein the rotatable assembly further includes a rotating handwheel which extends through an opening in the cover.

4. The air pump assembly of claim 3, wherein the motor is captured between the rotating handwheel and the pump housing.

5. The air pump assembly of claim 4, wherein the rotating handwheel maintains an orientation relative to each of the first air vent of the pump housing and the second air vent of the pump housing when the rotatable assembly is in both the first position and the second position.

6. The air pump assembly of claim 1, wherein the rotary disc is positioned vertically lower than the impeller.

7. The air pump assembly of claim 6, wherein the rotary disc includes a first air vent and a second air vent, the first air vent of the rotary disc communicating air to the first air vent of the pump housing when the rotatable assembly is in the second position and the second air vent of the rotary disc receiving air from the first air vent of the pump housing when the rotatable assembly is in the first position.

8. The air pump assembly of claim 7, further comprising a rotating handwheel, wherein the rotating handwheel maintains an orientation relative to the rotary disc when the rotatable assembly is in both the first position and the second position.

9. The air pump assembly of claim 6, wherein a sealing ring is positioned between the rotary disc and the housing and about the vent hole in the housing.

10. The air pump assembly of claim 6, wherein a pressure plate couples the rotary disc to the housing.

11. The air pump assembly of claim 1, wherein the impeller includes a circular ring cover plate having a central opening and at least one blade coupled to the circular ring cover plate.

12. The air pump assembly of claim 11, wherein the impeller further comprising a baffle extending from the circular ring cover plate in a first direction, the at least one blade extending from the circular ring cover plate in a second direction, the second direction being opposite the first direction.

13. The air pump assembly of claim 12, wherein the baffle is received in a recess in the pump housing.

14. The air pump assembly of claim 12, wherein the impeller further comprising at least one attachment blade extending from the baffle.

15. The air pump assembly of claim 1, wherein the rotatable assembly further includes a circuit board operatively coupled to the motor and a switch operatively coupled to the circuit board to control operation of the motor.

16. The air pump assembly of claim 15, wherein the cover includes a control plate which cooperates with the switch to control operation of the motor.

17. The air pump assembly of claim 1, wherein air flows from the pump housing through the rotary disc and into the inflatable product when the rotatable assembly is in the first position and air flows from the inflatable product through the rotary disc and into the pump housing when the rotatable assembly is in the second position.

* * * * *